US006451235B1

(12) United States Patent
Owens

(10) Patent No.: US 6,451,235 B1
(45) Date of Patent: Sep. 17, 2002

(54) FORMING A THREE DIMENSIONAL FIBER TRUSS FROM A FIBER SLURRY

(76) Inventor: Thomas L. Owens, 631 Sylvan Ct., Batavia, IL (US) 60510

( * ) Notice: Subject to any disclaimer, the term of this patent is extended or adjusted under 35 U.S.C. 154(b) by 0 days.

(21) Appl. No.: 09/558,929

(22) Filed: Apr. 26, 2000

(51) Int. Cl.[7] ..... B32B 1/26; B32B 21/36; D21J 3/00; D21J 1/04

(52) U.S. Cl. ..... 264/86; 264/87; 425/84; 425/85; 162/218; 162/221; 162/224; 162/227

(58) Field of Search ..... 264/87, 86; 425/85, 425/84; 162/218, 221, 224, 227

(56) References Cited

U.S. PATENT DOCUMENTS

| | | | | |
|---|---|---|---|---|
| 1,865,192 A | * | 6/1932 | Kappes | |
| 1,882,191 A | * | 10/1932 | Purinton | |
| 2,671,940 A | * | 3/1954 | Billner | |
| 3,305,437 A | * | 2/1967 | Crabtree | |
| 3,832,108 A | | 8/1974 | Posch et al. | 425/85 |
| 3,970,516 A | * | 7/1976 | Barkel et al. | 162/218 |
| 4,162,877 A | * | 7/1979 | Nyberg | 264/109 |
| 4,348,442 A | | 9/1982 | Figge | 428/72 |
| 4,495,237 A | | 1/1985 | Patterson | 428/178 |
| 4,702,870 A | | 10/1987 | Setterholm et al. | 264/87 |
| 4,994,148 A | | 2/1991 | Shetka | 162/227 |
| 5,064,504 A | | 11/1991 | Shetka | 162/396 |
| 5,833,805 A | | 11/1998 | Emery | 162/109 |
| 5,876,835 A | * | 3/1999 | Noble et al. | 264/86 |
| 5,900,304 A | | 5/1999 | Owens | 428/182 |
| 6,190,151 B1 | * | 2/2001 | Hunt | 264/87 |
| 6,210,531 B1 | * | 4/2001 | Bradford | 162/218 |

FOREIGN PATENT DOCUMENTS

| | | | | |
|---|---|---|---|---|
| JP | 5154811 A | * | 6/1993 | B28B/1/24 |

OTHER PUBLICATIONS

Gunderson, D.E., "Temperature and Restraint Variables in Continuous and Intermittent Press Drying", in Tappi Proceedings, International Paper Physics Conference, 1983, pp. 145–154.

* cited by examiner

*Primary Examiner*—Jan H. Silbaugh
*Assistant Examiner*—Adam R. Harris

(57) ABSTRACT

A method is disclosed for forming from a fiber slurry a three-dimensional fiber truss. The forming method involves compressing a fiber slurry or a fiber pulp between a pair of rigid foraminous dies to rapidly drive out most of the carrier fluid. The fiber retained between the dies is compacted into a pre-form fiber truss. The pre-form fiber truss is subsequently dried and consolidated in a heated press to produce a finished fiber truss. In panel applications, the fiber truss can be used by itself, or combined with other fiber trusses, to form a light-weight structural core for sandwich panels. Sandwich panels have numerous uses in packaging, material handling, construction, and furniture industries. Specific products include bulk bins, heavy-duty boxes, shipping containers, wall panels, roof panels, cement forms, partitions, poster displays, reels, desks, caskets, shelves, tables, and doors. Other structures that can be formed using the disclosed method and apparatus include egg containers, produce trays, molded packaging inserts, and molded pallets.

18 Claims, 8 Drawing Sheets

FORMING A THREE DIMENSIONAL FIBER TRUSS FROM A FIBER SLURRY

FILED OF THE INVENTION

This invention relates broadly to the production of three-dimensional structural components that make up the structural cores of lightweight composite sandwich panels and other load-bearing structures that have a high level of strength relative to structure weight. More specifically, the invention discloses a method and apparatus for forming from a fiber slurry a lightweight, fiber truss having three-dimensional features that reinforce the truss and that reinforce composite structures containing the truss.

BACKGROUND OF THE INVENTION

A three-dimensional fiber truss is defined herein as a fibrous element that has a strategically engineered three-dimensional shape designed to create, either stand-alone or in combination with other elements, a structural framework for load-bearing purposes. Typically, the wall thickness of a three-dimensional fiber truss will be small compared to the overall height of the three-dimensional features making up the fiber truss. With relatively thin walls, fiber mass is minimized relative to the strength and rigidity that may be attained in products that incorporate the fiber truss.

In many panel applications, the three-dimensional structure of the fiber truss consists of a series of hollow protrusions from a truss base. In this form, the fiber truss is bonded to exterior skins or to other fiber trusses. The composite structure formed in this way completes the three-dimensional truss work of the fiber truss element, and produces a product having a high level of strength and rigidity. A composite structure in which the fiber truss functions as a structural core between exterior skins is commonly known as a "sandwich panel." Because the flat sheets that form the exterior skins of the panels carry most of the stresses during bending, these composite sandwich panels are sometimes referred to as "stressed-skin panels".

Fiber trusses can be manufactured using a wide variety of methods and a diverse selection of materials, including metal filaments, wound fiber composites, folded paper sheets, and wood fiber compositions. The present invention is practiced using a narrowed class of materials composed of fibers that may be suspended and randomly distributed in a carrier fluid. Fibers of this type may be derived from various lignocellulosic materials as well as a wide range of synthetic materials. Different fiber types may be mixed together in the carrier fluid and/or a number of chemical additives may be applied to the fiber or fiber blend to achieve specific properties. The fiber trusses described in U.S. Pat. Nos. 5,900,304; 4,495,237; and 4,348,442 are examples of fiber trusses that may be produced using the disclosed method and apparatus.

When the fiber truss or core element is sandwiched between skins to complete the three-dimensional truss work, the resulting composite sandwich panel behaves in a manner analogous to a common I-beam, which is a very efficient engineering structure. By analogy, the fiber truss or core element corresponds to the central rib of the I-beam and the skins correspond to the top and bottom flanges of the I-beam. In bending an I-beam parallel to the central rib, one flange of the I-beam undergoes compression, while the other flange is in tension. In an analogous manner, bending of a composite panel places one of the skins in compression while the other skin is held in tension.

Numerous applications for sandwich panels exist in construction, furniture, material handling and packaging industries. The most common sandwich panel is the corrugated panel used extensively in light-weight box construction. In this case, the structural core is formed by bending thin paper sheets into an undulating or corrugated pattern. The corrugated cores are glued between paper skins to form the familiar corrugated panels. Numerous other lightweight structural cores and sandwich panels have been disclosed in the prior art, but only a few of these have been successfully commercialized. The honeycomb core is one of the more successful of these other cores.

The relative success of the honeycomb core and the corrugated core derive from the relative simplicity of their structural shapes and formation methods. There has been a need to define a correspondingly simple and cost-competitive method for constructing more complex structural core shapes which have improved structural properties. The present invention focuses upon such a method for the manufacture of a wide range of lightweight structural cores, and other load-bearing structures, using both natural plant fibers and synthetic or man-made fibers.

In the initial step of the method, the fibers are mixed in a carrier fluid to form a random or quasi-random fiber distribution. The mixture comprising fiber and carrier fluid will be referred to as a "fiber slurry" in this disclosure. Slurry formation is followed by a step in which the carrier fluid is almost completely discharged from the slurry and the retained fiber is concentrated and compacted in a wet-pressing operation, forming a pre-form fiber truss. Finally, the pre-form fiber truss is dried to form a finished fiber truss.

While the disclosed invention emphasizes the formation of fiber trusses used to construct core elements used in composite panels, the invention also can be used to form a wide range of molded fibrous products and components, including egg cartons, produce trays, conformal packaging, molded packaging inserts, and molded pallets. Well known conventional fiber-molding processes used to make these types of products begin by extracting fiber from a slurry and depositing the fiber onto a single forming mold using vacuum suction through a single porous mold containing an overlay of screen elements. Occasionally, air pressure is applied to the slurry either alone or in combination with vacuum extraction to increase the pressure differential which drives the carrier fluid through the porous mold and screen elements.

The equipment used for these conventional forming processes is fragile and expensive. For the more commonly utilized vacuum-only forming process, the pressure differential exerted across the porous mold and screen elements is limited to a maximum level equal to ambient air pressure. This low pressure differential results in comparatively slow carrier fluid removal and fiber formation. Fiber formation slows down substantially as product thickness increases.

In both vacuum-only processes and conventional gaseous-pressure-forming methods, slurry fluid-discharge and fiber deposition forces are applied across only a single forming surface. Single-surface fiber formation is not only a slow process, but fiber tends to be lumpy and wall thickness erratic. These conventional processes generally yield wet pre-forms having low solids content and high water content. High water content results in a fragile pre-form that is difficult to handle. The need to remove large quantities of water per pound of fiber leads to inefficiencies in energy usage and high costs in drying the wet pre-forms.

In the prior art, several improved methods are disclosed for forming from fiber slurries fiber trusses and other fiber structures, but these prior methods are still relatively complicated and expensive. For example, Setterholn and Hunt in U.S. Pat. No. 4,702,870 describe a method for forming specific three-dimensional structural components from wood fiber. Their method and apparatus require the use of a fragile resilient mold insert to form three-dimensional features in the finished fiber product. The use of resilient mold elements results in slow drying of the fiber, long production cycles, and maintenance problems associated with the fragility of the resilient mold elements. While the product formed according to the method of Setterholm and Hunt has excellent mechanical properties, the aforementioned problems associated with the resilient mold elements make the product expensive and limit the scope of applications. Nonetheless, the product has attracted considerable commercial interest and has had some degree of marketing success. Much greater success could be enjoyed with a simpler and more rapid manufacturing method.

A method and apparatus for producing a product similar to that of Setterholm and Hunt is disclosed by Emery in U.S. Pat. No. 5,833,805. In this case, solid mold elements are used, which allow rapid drying of the fiber form. The method and apparatus of Emery thereby improves the speed of production of three-dimensional fiber structures over that of Setterholm and Hunt. Nonetheless, the fiber is initially formed using a vacuum molding process that limits production speeds for the same reasons described previously for other vacuum-forming process. The method and apparatus disclosed by Emery also appears quite complicated. In addition, both the method of Setterholm and Hunt and that of Emery can be applied only to products having limited fiber truss thickness and a very specific structural form.

A method and apparatus for pulp molding have been disclosed by Shetka in U. S. Pat. Nos. 4,994,148 and 5,064,504. In this case, a pulp press and forming method are disclosed that utilize a pulp-molding chamber having interior walls comprised of rigid screens, through which water can pass, and rigid support plates outboard of the screens. The support plates contain fluid-discharge channels that collect water passing through the screens. The pulp is de-watered and compressed by squeezing the pulp between a moveable wall and a fixed opposed wall. Water is discharged through all interior surfaces of the pulp-molding chamber.

The use of screened walls on all interior surfaces is not conducive to the use of a sliding seal, captured in the periphery of the moveable wall, that slides along the surrounding screened walls. In fact, Shetka does not suggest the use of any seal in the space between the moveable wall and the surrounding screened wall. Without a seal in this space, leakage paths exist around the moveable wall, leading to the undesirable deposition of fiber in the space between the moveable wall and the wall which surrounds it. The leakage in this space also relieves the pressure that is applied to the pulp, leading to relatively low forming pressures. Low forming pressures result in low formation speeds.

It is apparent that the invention of Shetka is taught principally for the formation of relatively thick objects, such as blocks, flat boards, and solid panels. The fluid-discharge openings in the side walls adjacent to the moving wall of the device have advantages in the formation of thick objects, since substantial carrier fluid may be discharged from the perimeter of thick objects. Fluid-discharge openings in the side walls have no advantage in the formation of thin fiber trusses, since very little fluid discharge occurs from the thin edges of typical fiber trusses. Therefore, if Shetka had intended to include the formation of thin fiber trusses within the scope of his invention, he would have suggested the elimination of perforations in the walls surrounding the moveable wall. No such suggestion is made.

In fact, for thin-truss formation, there is a disadvantage in discharging the carrier fluid of a fiber slurry through the side walls. With side-wall fluid-discharge, fiber is deposited along the side wall and swept ahead of the moving wall during truss formation. This process results in excessive build-up of fiber around the perimeter of a thin truss at the expense of reduced fiber mass and fiber density over the rest of the truss, producing a poorly formed truss having weak interior regions.

Neither does Shetka suggest the formation of relatively complex three-dimensional surface features present on both sides of typical fiber trusses. Instead, Shetka suggests only the formation of shallow embossments on a single surface for decorative effect. Shetka does not suggest the use of these embossments for structural purposes. To form the embossments, Shetka inserts a solid, non-permeable template against the foraminous lower wall opposite the moveable wall of the invention. The template contains the impression of the desired embossment. Since the template covering the lower wall is impermeable, pulp fluid-discharge through the lower wall is blocked and the formation process is slowed considerably in forming the embossments.

Another device for forming three-dimensional molded objects from fiber slurries was disclosed by Posch et. al. in U.S. Pat. No. 3,832,108. The device includes a basic form, a moveable pressing form and a moveable frame surrounding the fixed basic form. The basic form and the pressing form are both liquid-pervious. The basic form is immersed in a fiber slurry and a layer of fiber is collected along the surface of the basic form using a vacuum forming process similar to that used in the conventional manufacture of molded fiber products. Once the fiber layer forms, the moveable pressing form compresses the deposited fiber layer, producing a smooth, accurately dimensioned surface. As was the case in common forming methods, fiber deposition occurs only over a single forming surface as carrier fluid is discharged through the forming surface under vacuum forces, leading to the same limitations in forming speed discussed earlier for other vacuum-forming processes.

Complete immersion of the basic form in a bath of fiber slurry, taught by Posch, et. al., necessitates withdrawal of the basic form from the slurry bath, or removal of the slurry from the basic form in order to recover the formed truss after it has been compacted by the pressing forms. In compaction and molding of the fiber layer with large compressive forces, bulky forms and a heavy mechanical support system are required. Movement of these very heavy components for the purpose of immersion in the fiber slurry followed by withdrawal of these components from the slurry, as implicit in one embodiment of the method of Posch et. al., would be complex, slow, and very costly.

The problem of devising a high-speed, cost-effective method for forming from a fiber slurry a wide range of three-dimensional fiber truss structures therefore remains extant.

SUMMARY OF THE INVENTION

It is an object of the present invention to define a simple, yet effective, method and apparatus for forming from a fiber slurry a fiber truss having relatively complex three-dimensional features that reinforce the fiber truss and reinforce composite structures containing the fiber truss. Fiber trusses formed according to the invention may be used individually or in combination to construct structural cores for sandwich panels having improved mechanical properties compared to corrugated and honeycomb panels. The fiber trusses may also take the form of various other molded structural fiber products, including egg cartons, produce trays, conformal packaging, molded packaging inserts, and molded pallets.

A preferred embodiment of the method includes two separate stages: a wet-forming stage, carried out at a wet-forming station, and a fiber truss drying and consolidating stage, carried out at a separate truss finishing station. In the wet-forming stage, a fiber slurry is added to a container bounded by smooth impervious straight walls. The bottom of the container is bounded by the forming surface of a rigid, foraminous wet-forming die that is fixed to the vertical walls of the container. This particular die will be referred to as the "fixed wet-forming die", since it is typically fixed in relation to the container walls or it provides the reference point for relative motion of the various parts of the forming apparatus. In some embodiments, the fixed wet-forming die may move relative to the laboratory frame of reference or the die may move relative to the container.

The forming surface of the fixed wet-forming die produces the impression of the under-surface of the fiber truss. The container walls, which form a frame around the fixed wet-forming die, will be referred to as the "deckle" because of similarities with a device having the same name used in common paper-making. Use of a deckle eliminates the need for immersion of the device in a slurry, distinguishing the present invention from the prior art of Posch, et. al., which was discussed earlier.

A second rigid, foraminous wet-forming die that is moveable with respect to the fixed wet-forming die is used to form the upper-surface of the fiber truss. This die will be referred to as the "moveable wet-forming die". The forming surface of the moveable wet-forming die produces the upper-surface of the fiber truss. The forming surface of the moveable wet-forming die may be nested into the forming surface of the fixed wet-forming die. Nesting in this manner during truss formation allows production of thin fiber trusses having substantially uniform wall thickness throughout.

The moveable wet-forming die is backed by a plunger that pushes the moveable wet-forming die along the deckle walls toward the fixed wet-forming die. Force may be applied to the plunger using a hydraulic press or a screw press or the like. The piston-like assembly formed by the moveable wet forming die and the plunger will be referred to as the "wet-forming punch" because of an analogy with the punch used in more common molding operations.

Slurry is added to the interior of the deckle enclosure and fills a space above the fixed wet-forming die. The space occupied by the slurry within the deckle enclosure and above the fixed wet-forming die will be referred to as the "slurry space." Fiber suspended in the slurry contained within the slurry space is rapidly concentrated near the forming surfaces of both the fixed wet-forming die and the moveable wet-forming die as the slurry is compressed between the dies and carrier fluid is discharged through fluid-discharge passages in both dies.

Carrier-fluid discharge and fiber deposition along the forming surfaces of both dies distinguishes the present invention from the inventions of Posch, et. al., Emery, and Setterholm and Hunt, all of whom teach fiber deposition on a single forming surface only. Discharge of carrier fluid and deposition of fiber on two forming surfaces, rather than a single forming surface, results in major improvements in forming speed and production of a smooth surface on both sides of the fiber truss. Because pressure is produced by applying force to a pair of wet-forming dies, the slurry may be discharged and the fiber compacted in one continuous motion of the moveable wet-forming die. There is no need to first complete the formation of a fiber layer, and then compact the fiber layer in a separate operation, as is sometimes done in conventional vacuum-forming and gaseous pressure-forming processes.

The carrier fluid is discharged from the slurry only through fluid-discharge passages in the pair of foraminous wet-forming dies. Carrier fluid is not discharged through the deckle encompassing the moveable wet-forming die, since the deckle is impervious in the present invention. The deckle of the present invention corresponds to the side walls which surround the moveable wall in the invention of Shetka. Unlike the present invention, the side walls in the invention of Shetka are pervious. Thereby, the side walls in the invention of Shetka provide a fluid-discharge path for the carrier fluid. The use of an impervious deckle and the elimination of carrier-fluid discharge through the deckle, disclosed herein, clearly distinguish the present invention from the prior art of Shetka.

If the deckle of the present invention were pervious, as taught by Shetka, slurry would be discharged from the edges of fiber masses. Edge discharge would have advantages if the fiber mass were very thick, since there would then be a large surface area for edge discharge. However, there would be no advantage in edge discharge from thin fiber trusses, to which the present invention applies, since the surface area available for fluid discharge from the edge of typical fiber trusses is very small. In fact, fluid-discharge openings in the deckle walls would lead to undesirable excess fiber deposition around the periphery of thin fiber trusses, as mentioned in the last section. Therefore, the present invention differs in both structure and function from the invention of Shetka.

In the present invention, wet-forming forces are applied by compressing the slurry between wet-forming dies using a hydraulic press or other press means, rather than by drawing the slurry through a single wet-forming die using vacuum suction or pushing the slurry through a single wet-forming die by pressurizing the air above the slurry. The disclosed wet-forming method that utilizes compressive forces between wet-forming dies clearly distinguishes the present invention from well-known conventional forming methods.

A sliding seal may be provided between the periphery of the moveable wet-forming die, or the plunger, and the interior walls of the deckle. With a good sliding seal, high slurry pressures may be attained within the deckle as the wet-forming dies press against the slurry, resulting in rapid discharge of carrier fluid through the foraminous dies and rapid formation of the fiber truss.

The sliding seal is preferably hermetic, although use of a close-fitting non-hermetic seal may also be advantageous. A sliding seal will decrease slurry flow substantially around the moveable wet-forming die, facilitating the generation of high slurry pressures and rapid formation speeds as the slurry is compacted between wet-forming dies. The smooth deckle walls provide an excellent sliding surface for the sliding seal, allowing formation of a tight seal against the deckle, and avoiding seal abrasion.

In the case of a sliding seal mounted to the wet-forming punch, composed of the moveable wet-forming die and the plunger, deckle fluid-discharge openings could produce severe wear and abrasion of the seal as the seal passed over the edges of the fluid-discharge openings on the perforated interior walls of the deckle. Therefore Shetka would not teach the use of a sliding seal against the deckle interior surfaces, further distinguishing the present invention from the prior art of Shetka. In fact, nowhere does Shetka suggest the use of a sliding seal in the practice or implementation of his invention.

A sliding seal could be mounted in the deckle walls of the present invention or the corresponding side walls of the invention of Shetka, although a seal is not suggested by Shetka. In this case, the seal would be fixed to the deckle and would slide against the exterior walls of the punch. As the punch squeezes out carrier fluid, the volume of the space between the punch and the deckle increases, drawing slurry into this space. Some fiber will then be deposited between the punch and the deckle, where it produces a frayed edge around the perimeter of the fiber truss. No such increase in volume or associated fiber deposition occurs if the sliding seal is fixed to the punch and slides along the deckle walls. Fixing the sliding seal to the punch and allowing the seal to slide along the deckle walls is therefore preferred to fixing the seal to the deckle walls and allowing the seal to slide along the punch.

Continuous pressure is applied to the wet-forming dies in the present invention until most of the carrier fluid is ejected and the fiber is compacted and molded into a fiber mass having the approximate shape of the finished fiber truss. The compacted and molded fiber mass will be referred to as a "pre-form fiber truss." At the completion of the wet-forming stage, the pre-form fiber truss still contains a small quantity of carrier fluid that must be removed in order to promote inter-fiber bonding. Inter-fiber bonding solidifies the fiber truss and forms a finished product. With adequate compaction in the wet-forming stage, the pre-form fiber truss, though still wet and soft, has enough wet strength for relatively aggressive handling, due in large part to the three-dimensional reinforcement inherent in the structure.

Because the wet-forming dies in the present invention may be constructed of strong rigid materials, very high forming pressures may be applied to compress and shape the pre-form fiber truss in the wet-forming stage. High forming pressures produce pre-form fiber trusses having relatively little retained fluids. The low fluid content of highly compacted pre-form fiber trusses results in low energy costs for subsequent drying of the pre-form fiber trusses.

It has been discovered through experimentation that there are circumstances in which the fluid-discharge passages in the wet-forming dies do not need to thoroughly cover the forming surfaces of the dies. Rather, the fluid-discharge passages need only be placed along the recessed surfaces of the wet-forming dies. In these locations, the fluid-discharge passages produce a flow pattern that deposits fiber very effectively into channels or pockets in the wet-forming dies, facilitating fiber formation in these more inaccessible portions of the forming surfaces. Since the walls of the dies are thinnest in the recesses of the forming surface, small-diameter fluid-discharge passages in these recessed areas are easily drilled or otherwise placed in the wet-forming dies.

Force to compress the slurry and discharge the carrier fluid may be applied using a hydraulic press. With a standard hydraulic press, very high carrier fluid pressures can be developed to discharge the carrier fluid rapidly. In one set of experiments using a hydraulic press, almost all of the water in a dilute wood-fiber slurry could be discharged in less than 3 seconds using the disclosed method. This fluid-discharge rate represents a substantial improvement in the state of the art. The pre-form fiber trusses produced in these fluid-discharge tests had moisture contents of 60% using a forming pressure of approximately 200 psi.

The slurries used in the wet-forming stage of the invention may include a single fiber type or a variety of fibers types that are mixed with a single carrier fluid or various carrier fluid mixtures, the most common carrier fluid being water. Common fiber types that may be used with the present invention include fibers derived from wood, straw, grass, cane, reed, bast, seed hair, other lignocellulosic materials, and non-plant synthetic materials. Within the category of fibers derived from wood, fibers from re-cycled wood sources offer a particularly low-cost source of fiber. Use of re-cycled fiber also helps conserve our forest resources while reducing waste inventories. These recycled fiber sources include wood fibers derived from old corrugated containers (OCC), old newspapers, and mixed paper. Chemical additives, such as fiber bonding agents, impregnating resins, fire retardant, sizing agents or other wet-strength additives, preservatives, anti-bacterial agents, and insect repellants may be mixed with the fiber slurry or applied after the fiber has been dried to impart special physical properties needed in some applications.

In the second stage of the method, the moist pre-form fiber truss is removed from the wet-forming station and transferred to the finishing station, where the pre-form fiber truss is dried. During removal of the pre-form fiber truss from the wet-forming station, the exceptional wet strength of the pre-form fiber truss allows separation of the pre-form fiber truss from the forming surfaces of the wet-forming dies without tearing or rupturing the pre-form fiber truss. High levels of wet-strength, compared to other forming methods, also allow transfer of the compacted pre-form fiber truss at high acceleration rates, an important feature for high-speed mass-production of fiber trusses.

Drying at the finishing station is performed, preferably, by rapid compression of the pre-form fiber truss between a pair of heated finishing dies. To distinguish the heated finishing dies from their wet-forming counterparts, one of the dies will be referred to as the "first hot-press die" and its forming surface will be called the "first heated forming surface". The other finishing die will be referred to as the "second hot-press die" and its forming surface will be called the "second heated forming surface."

Heat and pressure are maintained continuously between the hot-press dies until the fiber truss is dried to the desired level. With sufficiently rapid compression and heating of the pre-form fiber truss, a substantial amount of carrier fluid, typically liquid water, is driven out by the explosive expansion of steam that is created when the heated dies suddenly contact and rapidly compress the pre-form. Compared to relatively slow conventional press-drying, the rapid expulsion of liquid water in this process reduces the amount of water that must be vaporized. With less water to vaporize, less energy is required to dry the pre-form and the drying speed is increased. Drying speeds may be increased still further by applying a vacuum to one or both sides of the pre-form, as it is rapidly heated and compressed. These rapid-drying scenarios are commonly referred to in other contexts as "impulse drying." Impulse drying of thin paper sheets has been studied extensively for a number of years. Dramatic increases in drying speed and equally dramatic decreases in energy requirements have been reported for impulse drying in the paper industry. To our knowledge, impulse drying of more complex molded fiber products, including the fiber trusses of the present invention, has not been previously taught or implemented, distinguishing the present invention from all of the prior art.

Because the hot-press dies of the present invention can be made of metal, very high temperatures and pressures may be applied to the fiber truss as it is dried. For most practical purposes, temperatures of the hot press dies will be less than or approximately equal to 500 degrees F., which is dictated primarily by heat tolerance of the fiber rather than heat-tolerance of the dies. Consolidating pressures in excess of 2500 psi may be obtained with metal dies. The use of metal dies and the resulting ability to apply these high consolidating pressures and temperatures distinguishes the present invention from the invention of Setterholm, et. al.

The high-degree of fiber densification and strong inter-fiber bonding produced in the fiber truss when it is dried under continuous high-temperature and pressure, according to the present invention, creates a strong, dimensionally accurate, finished fiber truss having smooth surfaces on both of the extended sides of the truss. High temperature, high-pressure drying under continuous restraint also produces a finished fiber truss that is moisture resistant. Tolerance to moisture is confirmed by data reported by Gunderson in which moisture-resistant flat sheets of wood fiber were produced under similar conditions of continuous heat and pressure. Drying of fiber trusses may also be performed within the scope of the present invention without high-temperatures and without high-pressure restraint, resulting in a softer cushioning product, useful in many packaging applications.

If heated finishing dies are utilized in the drying stage of the present invention, the dies will most often be composed of metal. Metal dies may be actively and effectively heated with common heating sources such as steam, electric or gas heat. The forming surfaces of the finishing dies are in close contact with every surface of the fiber truss during truss consolidation and drying. For thin fiber trusses, thermal conduction paths are short, leading to very rapid and efficient heat transfer from actively heated metallic dies to all regions of the truss. If bonding agents are used, curing of the agents is also rapid because of the high thermal transfer rates. High thermal transfer rates, among other things, distinguish the present invention from the prior art of Setterholm, et. al.

In experimental tests of fiber truss formation performed according to the present method, drying times were 10 seconds for a truss wall thickness of 1.5 mm. and an overall structure thickness of 1 cm. This short drying time is considerably faster than drying times possible using the elastomeric mold elements disclosed by Setterholm et. al. Temperatures and compression rates in these tests were not optimal for rapid impulse drying. Nonetheless, some expulsion of liquid water, characteristic of impulse drying, was observed in the tests. More rapid drying rates, approaching those expected with impulse drying, would be obtained with increased temperatures and compression rates.

Typically, the forming surfaces of the heated finishing dies will closely match, or be identical to, the forming surfaces of the corresponding wet-forming dies. As such, the forming surfaces of the heated finishing dies nest into one another just as did the forming surfaces of the wet-forming dies. In order to produce the finished surface of the fiber truss, the finishing dies also substantially match the corresponding surfaces of the fiber truss. Because the finishing dies are capable of nesting into one another, a thin, light-weight finished fiber truss can be produced that has a substantially uniform wall thickness.

Once the fiber trusses are dried and consolidated at the truss finishing station, they may be joined together to form composite structural cores, or they may be used individually to form stand-alone structural cores. The cores may then be sandwiched between sheet liners, creating the panel-equivalent of an I-beam discussed earlier, and forming strong lightweight composite sandwich panels. The sheet liners may be composed of wood veneers, fiberboard, plastics, metals, or many other materials. Because the sheet liners are produced separately from the structural core, the physical properties of the core may be controlled independent of the physical properties of the sheet liners. Independent control of the sheet liner material relative to the core material enhances the versatility of these composite panels.

Since both the wet-forming dies and the finishing dies of the present invention are rigid, both sets of dies may be composed of a wide range of very durable materials, both metallic and non-metallic. Nearly any metal can be used to construct the dies including common metals such as aluminum and stainless steel. Ceramics may also be used, including the various grades of alumina, machinable glass-ceramics, and the less expensive machinable glass-mica composites. Plastics may be used as an inexpensive alternative to metals and ceramics in applications having sufficiently low forming pressures. Plastics that would be preferred in many applications include the various filled compounds which utilize base polymers of fluoroplastics, impregnated polyesters or polyethylene.

In contrast to prior methods for forming three-dimensional fiber objects using de-formable mold protrusions, taught by Setterholm, et. al., the protrusions extending from the forming dies of the present invention can be firmly and reliably attached to a base member using straightforward mechanical attachments, or through welding or brazing. In many cases, die protrusions may be machined directly into a solid blank, forming a very strong, durable one-piece forming die.

Because of the strength and durability of materials used in constructing the forming dies of the present invention, the dies will offer trouble-free performance in production applications and have a very long life expectancy compared to prior art molds made of relatively fragile elastomeric elements. In addition, the durable forming dies of the present invention will withstand the occasional presence of hard stray objects, such as staples, that might be accidentally contained in some slurries. These stray objects would destroy the elastomeric mold elements of the prior art. Tolerance to stray hard objects in slurries is a particularly important advantage when slurries are prepared from re-cycled sources of fiber in which material purity is often difficult to control.

The wet-forming method disclosed herein may be accomplished most simply by wet-forming individual fiber trusses one at a time in batch operations. In this case, all that is required is a single pair of wet-forming dies and a single deckle mounted to a single-opening press. Alternatively, several pre-form fiber trusses may be produced simultaneously using a series of die pairs and deckles mounted in a multi-opening press. It is conceivable that the fiber trusses could also be wet-formed continuously using moving molds in continuous belted presses, moving caul presses, counter-rotating roller presses, or the like.

The various fiber trusses that may be manufactured by the disclosed method have applications in a wide range of industries including packaging, material handling, construction, and furniture industries. A few of the specific products that can be fashioned using fiber trusses made according to the invention include pallets, bulk bins, heavy duty boxes, shipping containers, wall panels, roof panels, cement forms, partitions, poster displays, reels, desks, caskets, shelves, tables, and doors.

BRIEF DESCRIPTION OF THE DRAWINGS

The invention will be better understood with reference to the accompanying drawings, also forming part of this disclosure, wherein.

The figures illustrate only specific examples of the practice of the invention and are not intended to limit the scope of the claims.

DETAILED DESCRIPTION OF THE INVENTION

Figure 1:
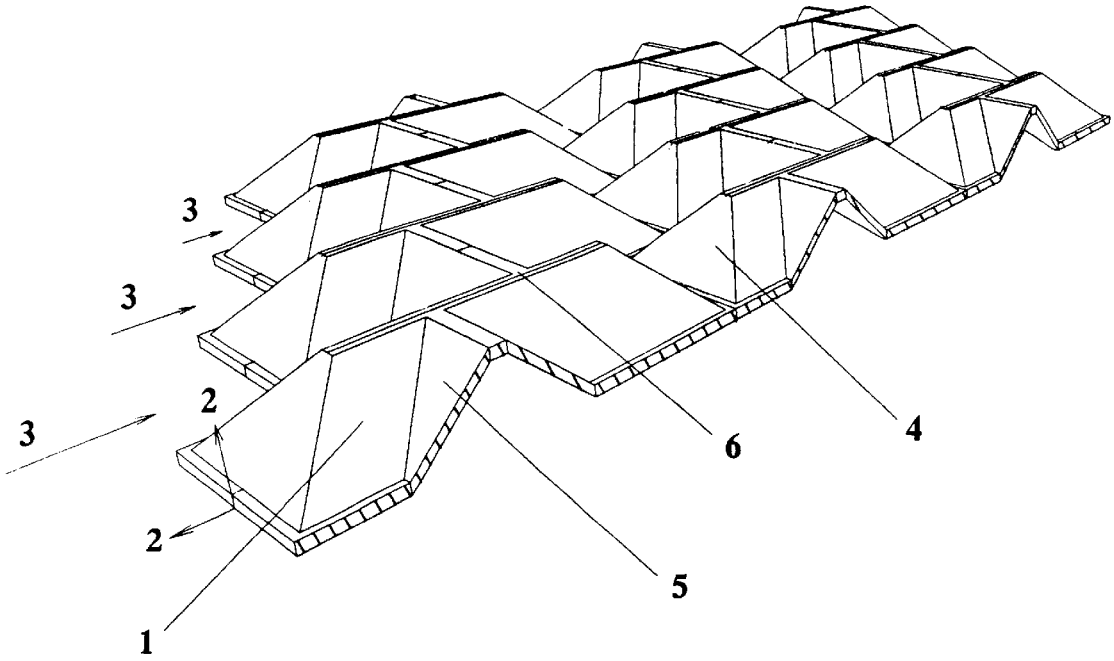
FIG. 1 is an example of a finished fiber truss like that disclosed in U.S. Pat. No. 5,900,304 which may be produced using the disclosed method and apparatus.

The method and apparatus disclosed herein can be used to rapidly form a variety of three-dimensional fiber trusses. FIG. 1 shows one example of a fiber truss that can be formed using the disclosed method. This particular fiber truss was previously claimed as an article of manufacture in U.S. Pat. No. 5,900,304 and does not form part of the present invention. The fiber truss is defined by two extended sides or surfaces of a relatively thin, fiber mass. Because of similarities in the features and appearance of the two sides of this particular fiber truss and the resultant difficulty in distinguishing one side from another, one side of the fiber truss will be referred to simply as the "first side" of the truss, and the opposite surface will be referred to as the "second side" of the truss, to avoid confusion. Typically, fiber trusses formed according to the present method are designed with a substantially uniform wall thickness throughout, although the scope of this invention also includes methods for making fiber trusses designed with non-uniform wall thickness.

More precisely, the structure depicted in FIG. 1 consists of a series of undulations or corrugations 1 along which are numerous V-shaped openings (referred to hereinafter as syncline indentations 4) downward into the ridges of the corrugations and other numerous inverted-V-shaped protrusions (referred to hereinafter as anticline protrusions 5) upward from the valleys of the corrugations. The anticline protrusions 5 may have the same height as the corrugations, as shown in FIG. 1, or they may be set back from the ridges of the corrugations. The directions of the axes of the corrugations are indicated by the arrows 3 in FIG. 1, for reference. The direction of the valleys of the syncline indentations 4 and the ridges of the anticline protrusions 5 are approximately normal to the axes of the corrugations in the figures. Other relative angles may be used if desired.

The walls formed by the syncline indentations 4 and anticline protrusions 5 span or bridge the space between adjacent walls of the corrugations. By bridging this space, the syncline indentations 4 and anticline protrusions 5 act as a type of gusset or stiffener for the corrugations 1. They also provide strength and stiffness in directions normal to the axes of the corrugations. A fiber truss fashioned in this manner holds its as-molded form without the need for additional support. The self-supporting feature of the fiber truss makes it relatively straightforward to handle and to process further. Sheet materials, or skins, may be readily bonded to the ridges 6 of the truss, since the ridges are easily accessible and conducive to the use of common adhesive applicators. The self-supporting feature of the truss also facilitates assembly into stacked, multiple-truss configurations.

Once the fiber truss shown in FIG. 1 is bonded to exterior skins or is bonded to other fiber trusses, the composite sandwich panel has a high degree of strength and stiffness, particularly in relation to its weight, making the structure useful in numerous load-bearing applications. In one set of compression tests, a composite sandwich panel made with a structural core similar the structure shown in FIG. 1 and composed of 100% recycled fiber derived from old corrugated containers (OCC) withstood compressive forces equivalent to more than 20,000 times the weight of the fiber truss.

Figure 2:
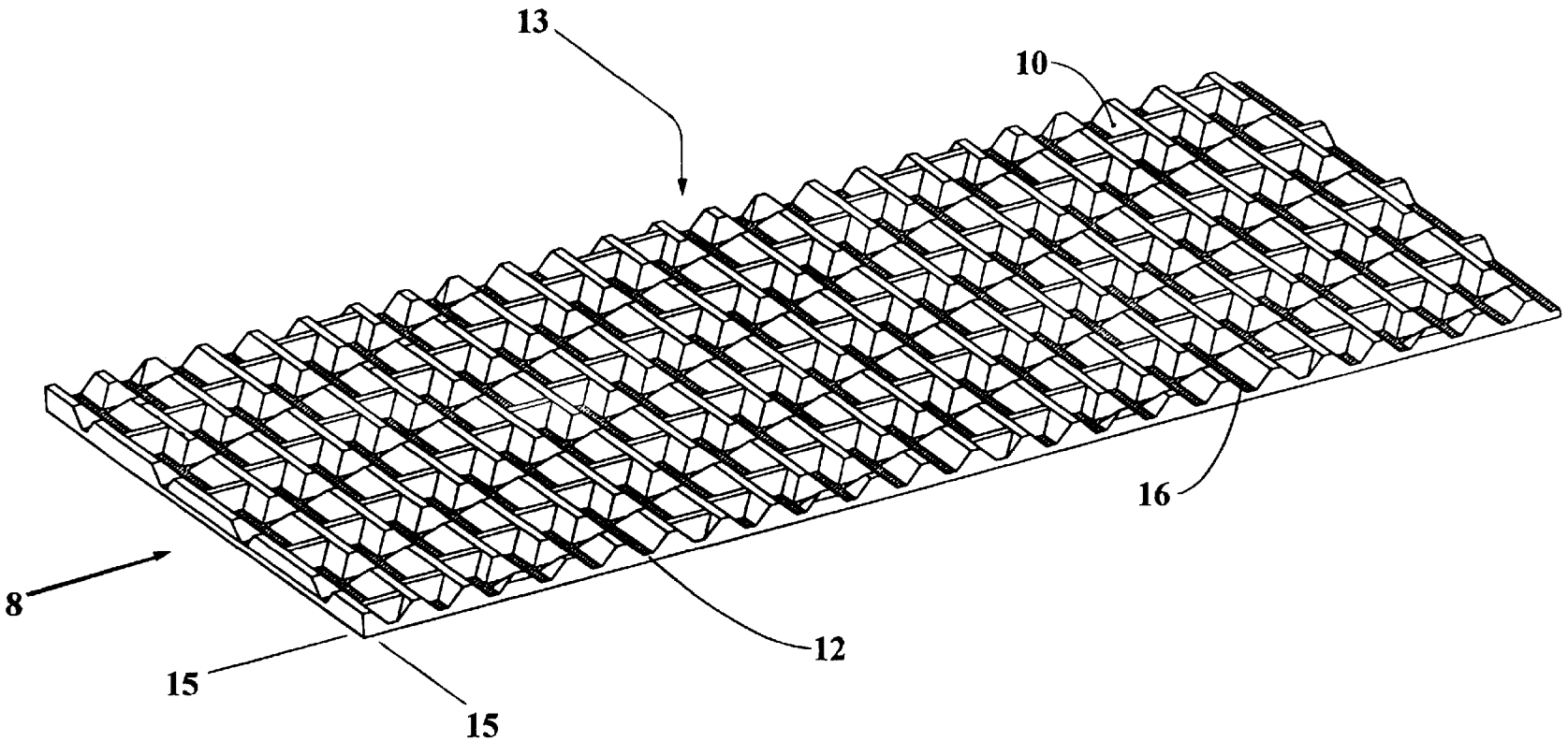
FIG. 2 is a perspective drawing of a forming die that could be used to produce one side of a pre-form fiber truss or one side of a finished fiber truss that has the structure depicted in FIG. 1. A second forming die (not shown) which nests into the die shown in FIG. 2 would be used to form the second side of the pre-form fiber truss or finished fiber truss.

FIG. 2 is a perspective drawing of one embodiment of a wet-forming die 8 that is used to produce a large fiber truss having a structure like that shown in FIG. 1. The wet-forming die 8 shown in FIG. 2 consists of a series of polyhedral protrusions 10 extending upward from a base panel 12. The exposed forming surface 13 produced by the base panel 12 and the protrusions 10 of the wet-forming die 8 closely match the shape of the first side of the fiber truss. The apices of the protrusions 10 of the wet-forming die 8 are flat and form the bottoms of valleys on the first side of the fiber truss.

In a similar fashion, the base panel 12 of the die 8 forms the peaks of the fiber truss on the first side of the truss. The base panel 12 contains fluid-discharge passages 16 in regions between protrusions 10 to allow carrier-fluid discharge during wet-formation of the fiber truss. The fluid-discharge passages 16 extend from the forming surface 13 to a flat back surface opposite the forming surface on the back side or underside of the die shown in FIG. 2. The die periphery 15 is the surface which connects the forming surface 13 to the back surface of the die 8 and which forms the edge of the die 8.

In this particular example, the protrusions 10 are impervious. Other arrangements of fluid-discharge passages may be used, including placement of additional fluid-discharge passages in the protrusions 10. The fluid-discharge passages 16 in the foraminous base panel 12 are small enough to substantially prevent the passage of fiber though the fluid-discharge passages 16 in the base panel 12 but large enough to allow rapid carrier-fluid discharge.

In wet-forming the pre-form fiber truss, a second wet-forming die is used to form the second side of the pre-form fiber truss. To form a typical fiber truss that is relatively thin and has a substantially uniform thickness throughout, the second wet-forming die has a surface that nests or fits into the forming surface of the first wet-forming die 8. Considering the structure of the first die 8, the second die thus consists of similar polyhedral protrusions or protuberances extending outward from a base panel. The second wet-forming die has the general appearance of the first wet-forming die, but in detail the forming surface of the second die is shaped for nesting into the forming surface of the first die 8. In the region between protrusions, the base panel for the second die is also foraminous to allow an additional escape path for carrier fluids in the fiber slurry. As was the case for the first die 8, other arrangements of fluid-discharge passages may be used in this second die, including placement of additional fluid-discharge passages in the protrusions of the second die.

It has been determined through experimentation that for fiber trusses of the type shown in FIG. 1 and described in U.S. Pat. No. 5,900,304, the method disclosed herein produces a uniform fiber distribution in the finished fiber truss even when the fiber slurry is discharged only through the foraminous base of each die. With a simple, flat base 12, as depicted in FIG. 2, it is relatively easy to fabricate fluid-discharge passages. For the die 8 shown in FIG. 2, the fluid-discharge passages 16 between protrusions 10 from the base panel 12 can be produced by drilling a set of small holes completely through the base panel 12 from the back side of the base 12. Since the back side of the base panel 12 is flat and thin in this example, very small drill bits can be used to form very small fluid-discharge passages 16 in the base panel 12. For tests of the concept, a die like that shown in FIG. 2 was fabricated from aluminum stock with drilled fluid-discharge passages 0.5 mm in diameter and 3.8 mm long in the base regions between the protrusions. Passages of this size could also be efficiently produced by means of laser drilling or other well-known techniques.

Figure 3:
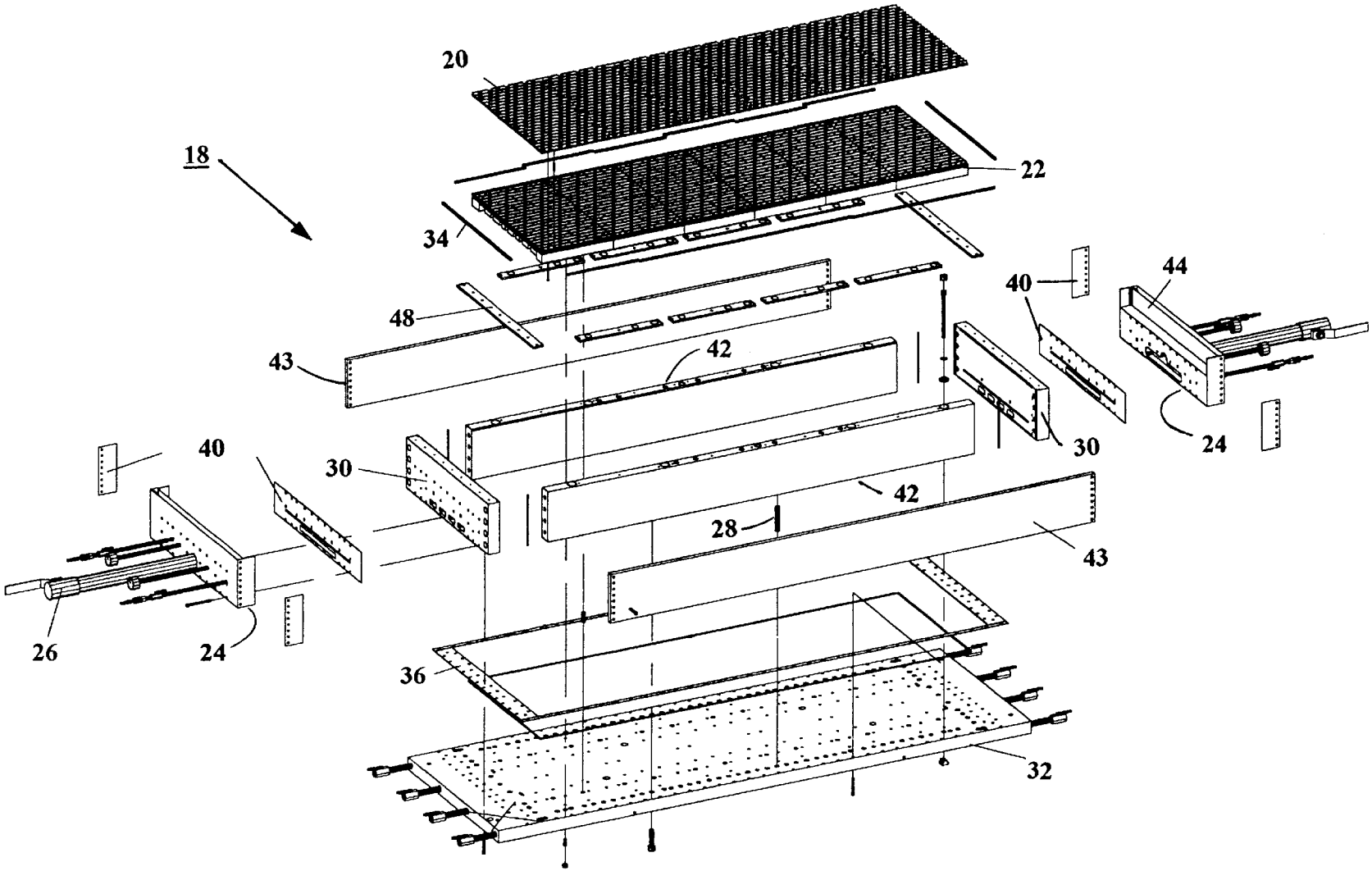
FIG. 3 is an exploded view of the lower forming assembly of one embodiment of the invention.

FIG. 3 shows an exploded view of a lower forming assembly 18 that was designed for testing the forming process which incorporates wet-forming dies like the die 8 shown in FIG. 2. The lower forming assembly 18 illustrated in FIG. 3 presents an example of a device that includes many of the novel elements of the invention. In FIG. 3, a series of 6 individual dies similar to the wet-forming die 8 shown in FIG. 2 are connected together to form a large die assembly which becomes the fixed wet-forming die 20 for the lower forming assembly 18. The dimensions of the fixed wet-forming die 20 fabricated according to FIG. 3 for tests of the inventive concept were approximately 61 cm wide, 183 cm long with protuberance heights of 1 cm. The back side of the fixed wet-forming die 20 is attached to a fluid-discharge plate 22 that contains a series of channels for catching fluid that is discharged from the fluid-discharge passages 16 in the individual sections of the fixed wet-forming die 20. The fluid-discharge plate 22 is, in turn, attached to a base plate 32 that provides rigid support of the forming assembly and includes an accessible mounting flange for attachment to the platen of a press.

An enclosure which surrounds the fluid-discharge plate 22 and the fixed wet-forming die 20 is formed by assembly of a pair of side walls 42 and a pair of end walls 30. The complete enclosure assembly is sealed in the corners and forms a deckle 38 which contains the fiber slurry. The side walls 42 and the end walls 30 of the deckle 38 for the fabricated test apparatus were approximately 5 cm thick. A thick wall in the deckle 38 is required to minimize deckle wall deflection as the fiber slurry is squeezed between wet-forming dies at high pressures.

The bottom end of the deckle 38 is attached to the base plate 32. A large number of steel pins 28 extend from holes in the base plate 32 into holes in the walls of the deckle 38. The steel pins 28 provide additional support for the deckle 38 and prevent deflection of the deckle during high-pressure forming of the fiber slurry. A stationary deckle gasket 36 seals the bottom edge of the deckle against the base plate 32. The bottom portion of the inside wall of the deckle 38 surrounds the fluid-discharge plate 22 and the fixed wet forming die 20. A fluid-discharge plate seal 34 between the outside edge of the fluid-discharge plate 22 and the inside walls of the deckle 38 prevents the flow of slurry around the perimeter of the fixed wet-forming die 20. The assembly comprising the base plate 32, the fluid-discharge plate 22, and the fixed wet-forming die 20 form a bottom cover for the deckle 38. The fiber slurry may then occupy a slurry space above the fixed wet-forming die 20 and within an enclosed interior space of the deckle 38 during the wet-forming stage.

The channels in the fluid-discharge plate 22 direct the flow of separated carrier fluid to fluid-discharge manifolds 24 on either side of the forming assembly 18. A pair of manifold gaskets 40 seals the space between the deckle end walls 30 and the fluid-discharge manifolds 24. Carrier fluid is extracted from fluid-discharge ports 26 in the manifolds 24. The extracted carrier fluid may be re-circulated back into the system and used to form additional fiber slurry, if desired. A secondary enclosure defined by overflow plates 43 and cutouts 44 in the fluid-discharge manifolds 24 is used to trap fluids that may accidentally overflow the deckle 38 or leak from the deckle 38, particularly as the fiber slurry is squeezed between dies during the wet-forming operation.

Figure 4:
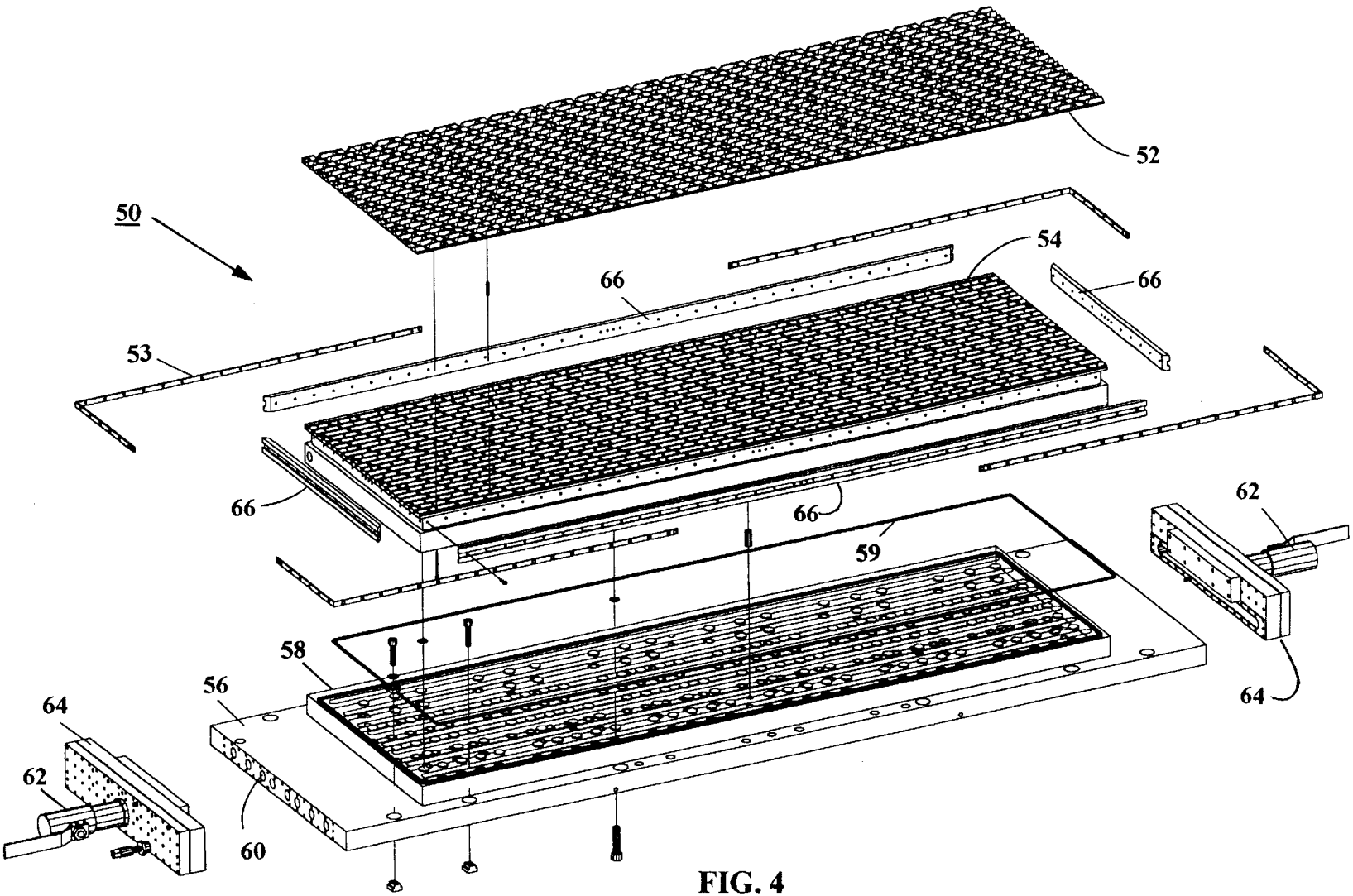
FIG. 4 is an exploded view of the upper forming assembly of the embodiment corresponding to FIG. 3.

FIG. 4 shows an inverted and exploded view of the upper forming assembly 50. The upper forming assembly 50 incorporates wet-forming dies similar to the wet-forming die 8 shown in FIG. 2. As was done in the construction of the lower forming assembly 18, a series of 6 dies are connected together in the upper forming assembly 50 to form a large die assembly which becomes the moveable wet-forming die 52 for the upper forming assembly 50. As was true for the individual die 8, and its mating die, the moveable wet-forming die 52 has a forming surface that nests inside of the forming surface of the fixed wet-forming die 20.

The back surface of the moveable wet-forming die 52 is attached to a plunger 54. The plunger 54 transmits to the moveable wet-forming die 52 the forces which press the moveable wet-forming die 54 against the slurry and compact the pre-form fiber truss. The plunger 54 has considerable thickness to allow the moveable wet-forming die to reach deep into the interior of the deckle 38. The assembly comprising the moveable wet-forming die 52 and the attached plunger 54 form the wet-forming punch 55 defined earlier. The face of the plunger 54 that attaches to the back surface of the moveable wet-forming die 52 contains a series of channels for catching fluid that is discharged from the passages 16 in the individual sections of the moveable wet-forming die 52. In operation, the plunger 54 and moveable wet-forming die 52 are driven downward into the deckle 38 after fiber slurry has been added to the slurry space within the interior of deckle 38.

A pre-selected quantity of slurry may be added to the interior of the deckle 38 by dispensing the slurry through the top opening of the deckle 38 prior to insertion of the punch 55 into the deckle 38. Slurry may also be added to the interior of the deckle 38 by flowing slurry through slurry inlet openings 82 leading to the slurry space in the interior of the deckle 38. The slurry inlet openings 82 may be placed in the walls of the deckle 38 or in the bottom cover of the deckle 38. With slurry inlet openings 82 in these locations, the moveable wet forming die 52 does not need to be removed from the deckle 38 as slurry is added to the interior of the deckle 38. However, the moveable wet-forming die 52 and the plunger 54 must not block the slurry inlet openings during the slurry filling operation.

Pressure is applied to the slurry as the moveable wet-forming die 52 contacts the slurry and compresses it against the fixed wet-forming die 20 within the deckle interior. Carrier fluid in the slurry is driven out through the fluid-discharge passages 16 while fiber is deposited against the forming surfaces of the moveable wet-forming die 52 and the fixed wet-forming die 20.

Plunger sliding seals 66 are attached to a groove machined into the periphery of the plunger 54. For the test apparatus patterned after the embodiment shown in FIG. 4, the seals 66 were fabricated from polytetrafluorethylene (PTFE). As mentioned earlier, a number of other seal materials could also be used. The seals are held in place by a set of four metal retainer strips 53 that fit into grooves in the seals 66. The seals 66 are sandwiched between the retainer strips 53 and the groove in the periphery of the plunger 54. The retainer strips 53 are attached to the plunger 54 using a large number of metal screws. In principle, seals could be placed anywhere around the periphery of the wet-forming punch 55, including around the periphery of the moveable die 52. In the present embodiment, the seals were placed around the plunger 54 because of the greater peripheral area of the plunger 66 compared to the peripheral area of the moveable wet-forming die 52. While the seals 66 shown in FIG. 4 are not hermetic seals, due to their segmented construction, they still provide a high level of slurry containment as the slurry is compressed. It is a straightforward matter to substitute a single-piece sliding hermetic seal for the segmented seals 66 shown in FIG. 4 to improve performance still further.

The plunger seals 66, slide along the smooth wall of the deckle 38 as the plunger 54 is driven into the deckle 38. The sliding seals 66 help prevent the undesirable escape of slurry around the periphery of the moveable wet-forming die 52 as the slurry is being compressed. The seals 66 also allow the build-up of very high slurry pressures within the deckle 38 as the wet-forming die 52 is driven against the slurry within the interior of the deckle 38. High slurry pressures produce rapid fluid-discharge of the carrier fluid in the slurry and rapid deposition of fiber on the forming surfaces of the wet-forming dies 20 and 52.

The back side of the plunger 54 is attached to a spacer plate 58 that provides rigid support and extended height for the plunger 54. Extended height is needed to allow the moveable wet-forming die 52 attached to the plunger 54 to reach the bottom of the deckle 38 where the forming surfaces of the dies 20 and 52 will nest into one another. A spacer-plate seal 59 is placed in a groove machined around the upper face of the spacer plate 58 as depicted in FIG. 4 to prevent fluid leakage between the spacer plate 58 and the plunger 54. The opposite side of the spacer plate 58 is attached to an upper base plate 56. The upper base plate 56 is wider than the plunger 54 and the spacer plate 58 to provide an accessible mounting flange for attachment of the upper forming assembly 50 to the upper platen of a press.

The upper base plate 56 contains a series of fluid-discharge channels which connect to fluid-discharge holes 60 in the ends of the upper base plate 56. The fluid-discharge channels in the upper base plate 56 are aligned with matching channels in the spacer plate 58. These channels allow passage of carrier fluid from fluid-discharge passages in the plunger 54 to the fluid-discharge channels in the upper base plate 56. Manifolds 64 are attached to each end of the upper base plate 56 to collect carrier fluid from the fluid-discharge holes 60 in the upper base plate 56. Carrier fluid is extracted from the upper forming assembly 50 through upper fluid-discharge ducts 62.

A series of press stops 48, shown in FIG. 3, may be attached to the top edges of the deckle 38 on the lower forming assembly 18. The stops 48 limits the closure of the press when the upper base plate 56 contacts the stops 48. The thickness of the stops 48 determines the thickness of the formed truss. In addition, when the upper base plate 56 contacts the stops 48, the moveable wet-forming die 52 is constrained to be substantially parallel to the fixed wet-forming die 20. Uniform truss thickness and precise truss formation can be obtained by this means.

Figure 5:
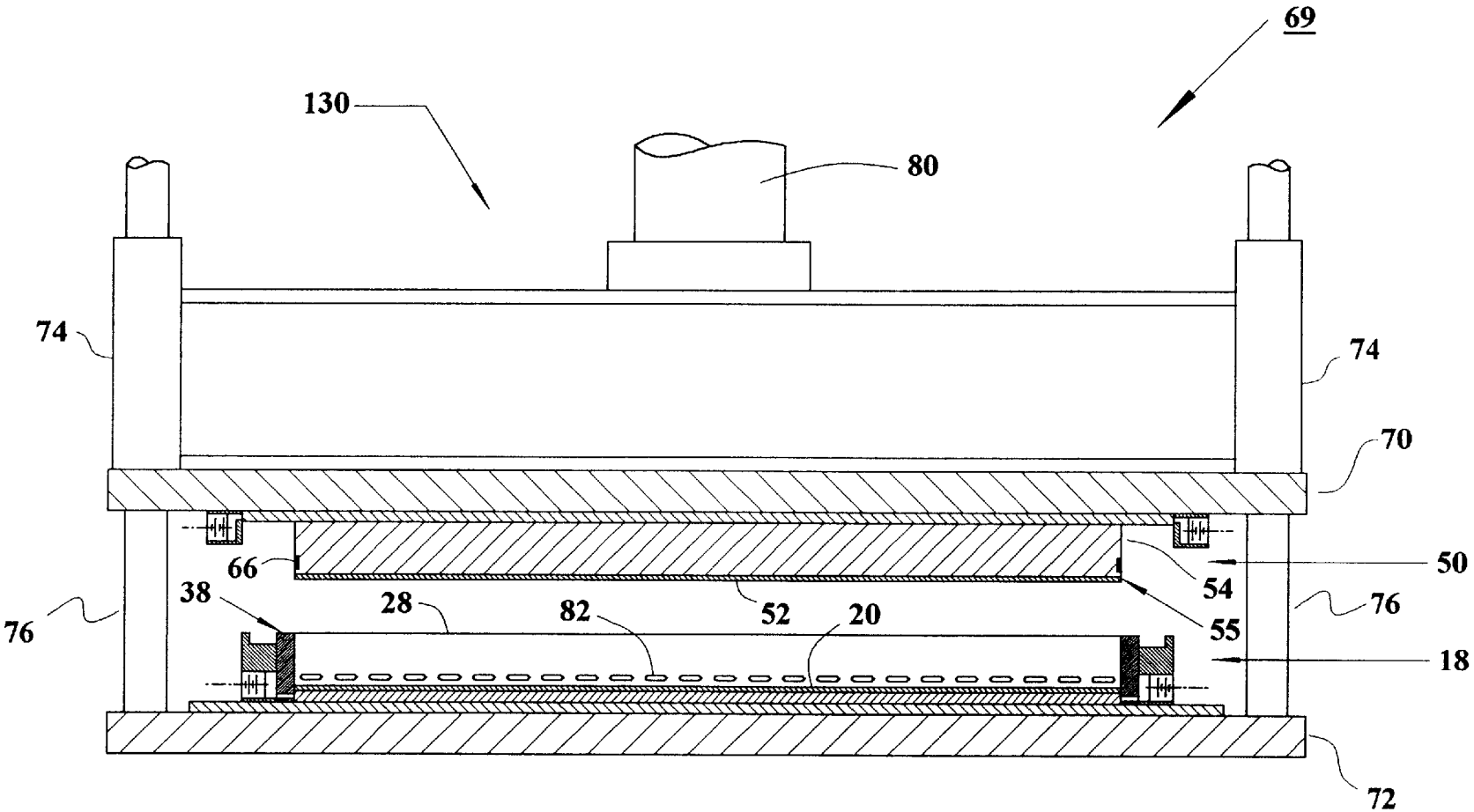
FIG. 5 is a side view of an embodiment of a wet-forming station which uses a standard four-post hydraulic press and the forming assemblies shown in FIGS. 3 and 4 mounted to the platens of the press.

FIG. 5 shows a cross-sectional side view of a complete wet-forming station 69. In the figure, the upper forming assembly 50 is attached to the upper platen 70 of a hydraulic press 130, and the lower forming assembly 18 is attached to the lower platen 72 of the hydraulic press 130. The hydraulic press 130 depicted in FIG. 5 is a standard four-post hydraulic press, although a variety of other standard presses may be used. Using the four-post press, a moveable carriage 78 is guided by linear bearings or bushings 74 which slide on steel posts 76. The steel posts 76 are fixed to the lower platen 72. The moveable carriage 78 carries the upper forming assembly 50. During the down-stroke of the hydraulic press 130, the carriage 78 guides the punch 55 of the upper forming assembly 50 in relation to the deckle 38 of the lower forming assembly 18. The hydraulic press 130 in this embodiment is equipped with a steel ram 80 driven by an industrial hydraulic cylinder (not shown). Preferably, the hydraulic cylinder should be capable of producing a pressure of at least 100 pounds per square inch (psi) at the die forming surfaces.

In the embodiment depicted in FIG. 5, a series of slurry inlet openings 82 are shown along the base of the deckle side walls 42. The slurry inlet openings 82 are backed by slurry headers (not shown) on the exterior side of the deckle walls 42. The headers convey slurry from a slurry preparation system to the slurry inlet openings 82 and distribute the slurry along the array of openings 82. After completion of the downward stroke of the punch 55 and compaction of the pre-form fiber truss, the punch 55 is immediately drawn upward within the deckle 38. Just before the punch 55 is withdrawn, fluid-discharge paths leading to the fluid-discharge passages 16 are sealed off in both the top forming die 52 and the bottom forming die 20.

As the punch 55 is drawn upwards within the deckle 38, a vacuum is produced within the expanding open volume on the interior of the deckle 38. During this operation, the sealed fluid-discharge passages 16 and the sliding plunger seals 66 prevent air infiltration into the deckle 38. By placing a series of slurry inlet openings 82 at the base of the deckle 38, the vacuum suction produced during withdrawal of the punch 55 can be used to rapidly draw slurry into the deckle 38 through the slurry inlet openings 82 without the need for a separate slurry pumping system. Thereby, the press is efficiently utilized, the overall device is simplified, and the formation cycle-time is minimized.

The punch 55 is withdrawn completely from the deckle 55 in order to remove the pre-form fiber truss. As the punch 55 is withdrawn from the deckle 38, the compacted pre-form fiber truss is held against the moveable wet-forming die 52 by vacuum forces applied to the fluid-discharge passages 16 in the moveable wet-forming die 52. A small gap can be maintained between the retreating pre-form fiber truss and the slurry by withdrawing the punch 55 at a sufficiently rapid rate to create a low-pressure void between the advancing slurry and the pre-form fiber truss. The void prevents contact between the compacted pre-form fiber truss and the slurry to avoid disturbance of the exposed fiber surface of the pre-form. Alternatively, a void may be produced by drawing into the deckle a small amount of air during a short initial portion of the stroke of the retreating punch 55. By providing a large number of slurry inlet openings 82 along the length of the deckle 38, fiber in the slurry will be uniformly distributed over the forming surfaces 13 of the wet-forming dies 20 and 52.

Figure 6:
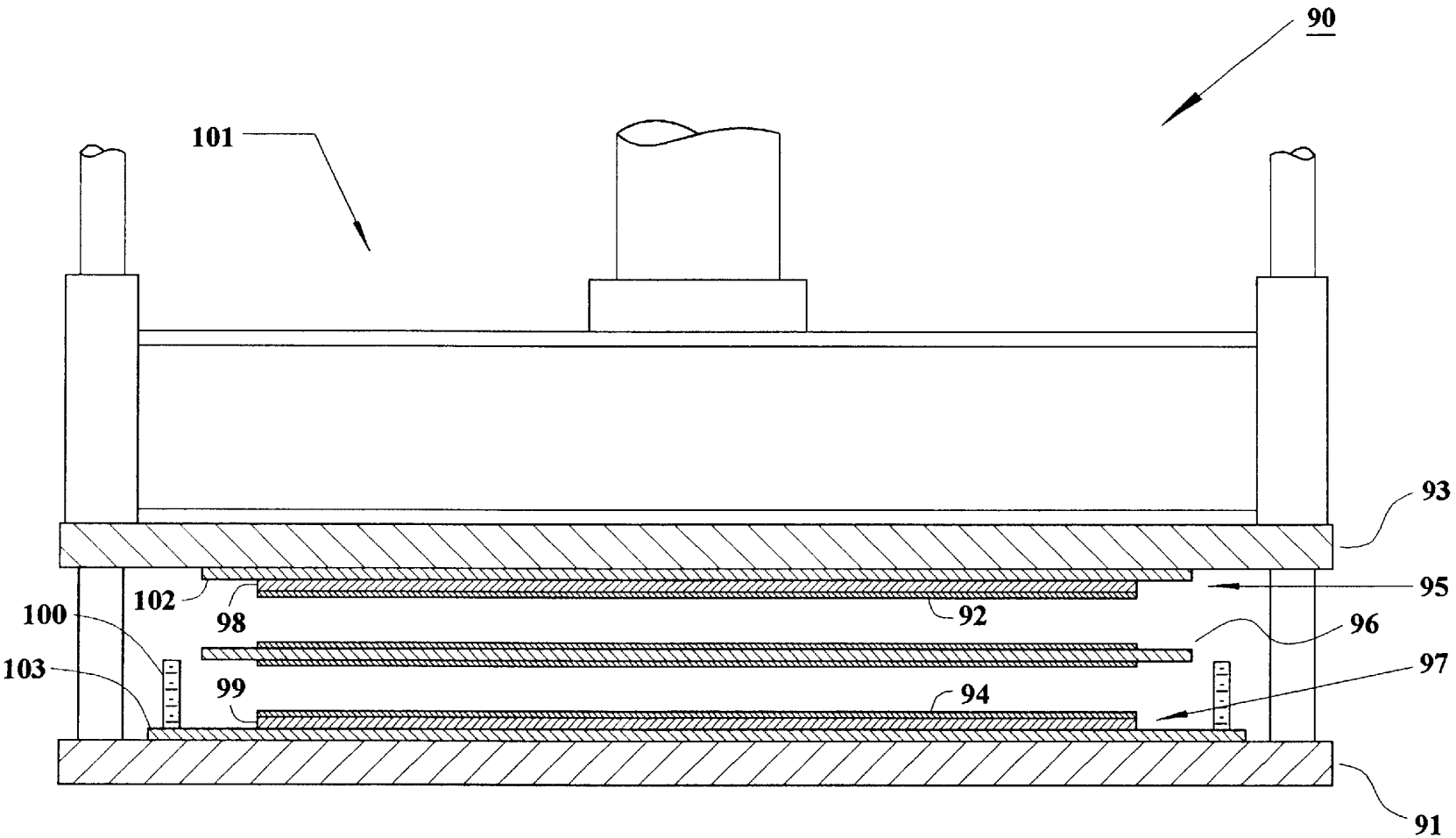
FIG. 6 is a side view of an embodiment of a truss finishing station which uses a standard four-post hydraulic press.

FIG. 6 shows some of the components of the truss finishing station 90, where the moist pre-form fiber truss is compacted still further and dried under pressurized restraint between heated forming dies to produce the finished fiber truss. The forming dies of the truss finishing station 90 include a moveable upper hot-press die 92 and a fixed lower hot-press die 94. The dies 92 and 94 have essentially the same forming surfaces as their respective wet-forming counterparts, 52 and 20. In addition, both hot-press dies 92 and 94 include a series of venting passages at the bottoms of recesses in the forming surfaces. Steam is released through these venting passages during consolidation and drying of the fiber truss. For example, in formation of the fiber truss shown in FIG. 1, the forming surfaces of the hot-press dies 92 and 94 would look very much like the forming surface 13 of the wet-forming die 8 shown in FIG. 2. The venting passages of the hot-press dies 92 and 94 would then correspond to the fluid-discharge passages 16 between protrusions 10 in the wet-forming die 8.

Each die 92 and 94 is supported by a venting-plate 98 and 99 that contains channels for releasing steam during the drying operation. Each venting plate 98 and 99, in turn, is backed by a mounting plate 102 and 103. The upper hot-press die 92 together with its associated venting plate 98 and mounting plate 102 form the upper finishing assembly 95 that attaches to the upper platen 93 of a heated-platen press 101. The lower hot-press die 94 together with its associated venting plate 99 and mounting plate 103 form the lower finishing assembly 97 that attaches to the lower platen 91 of the heated-platen press 101.

A moveable transfer plate, or caul 96, is positioned in the opening between the hot-press dies 92 and 94 in FIG. 6. The caul 96 carries the completed pre-form fiber truss from the wet-forming station 69 to the finishing station 90, where the pre-form fiber truss is dried in the hot press 101. After the pre-form fiber truss has been dried and consolidated at the finishing station, the caul 96 carries the finished fiber truss from the finishing station 90 to a post processing station. The upper and lower surfaces of the caul 96 may be shaped to substantially match the surfaces of the attached fiber trusses in order to maintain the shape of the pre-form fiber trusses during transfers, and to hold the fiber trusses firmly to the surfaces of the caul 96.

Figure 7:
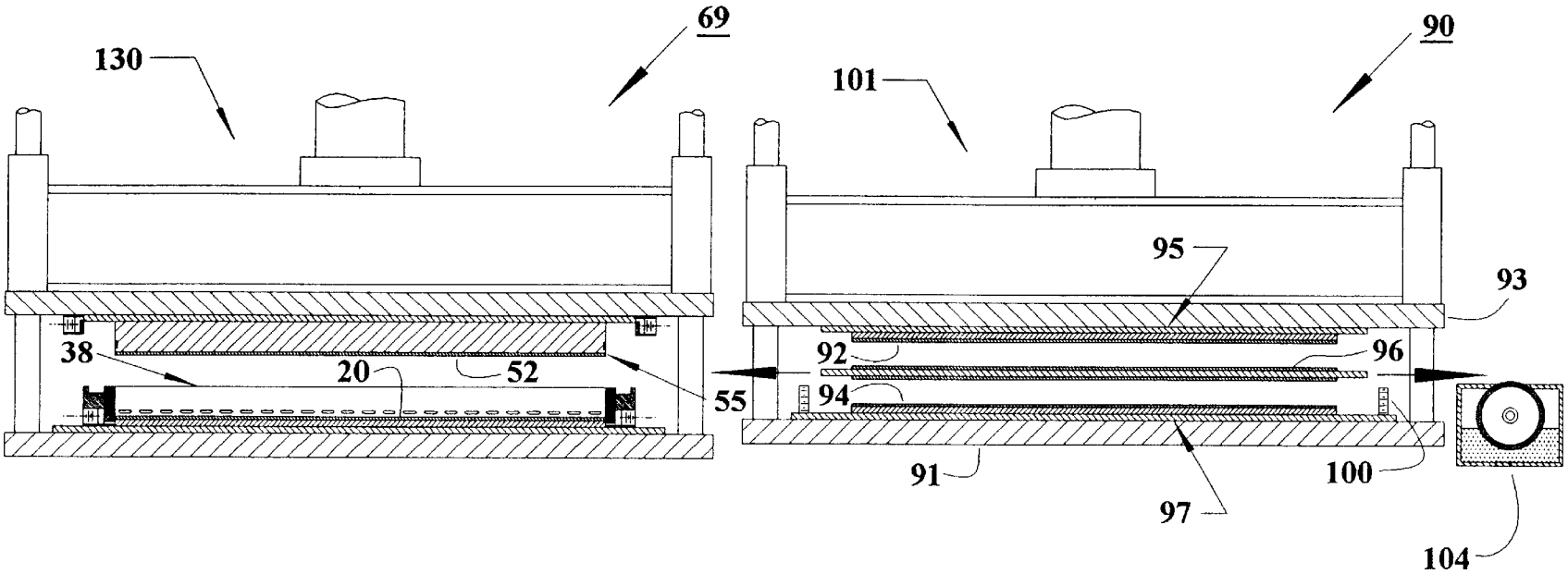
FIG. 7 is a side view of the principal functional components of a mass production apparatus, including the wet-forming station from FIG. 5 and the truss finishing station from FIG. 6.

FIG. 7 shows a complete fiber truss forming apparatus, including the wet-forming station 69 and the finishing station 90. To produce a finished fiber truss, the production cycle begins with the following initial conditions:

(a) The deckle 38 is filled with fiber slurry to a predetermined level.

(b) The punch 55 of the wet-forming station 69 is fully withdrawn from the deckle 38.

(c) The heated-platen press 101 is fully opened at the truss finishing station 90.

(d) The upper surface of the caul 96 initially holds a moist pre-form fiber truss that was carried on the caul 96 from the wet-forming station 69 to the truss finishing station 90 in a prior step.

(e) A finished fiber truss is held on the lower hot-press die 94. The finished fiber truss was dried and consolidated in a previous step.

To begin the truss-formation cycle, the wet-forming press 130 at the wet-forming station 69 is energized and the punch 55 is driven into the deckle 38. Pressure is applied to the slurry through the downward force of the punch 55. Carrier fluid is rapidly discharged through the fluid-discharge passages 16 in both the moveable wet-forming die 52 and the fixed wet-forming die 20. The fiber in the slurry collects simultaneously along the forming surfaces of both the moveable wet-forming die 52 and the fixed wet-forming die 20. After most of the carrier fluid has been discharged from the slurry, the fiber captured between the moveable wet-forming die 52 and the fixed wet-forming die 20 is compacted by the wet-forming dies 52 and 20 into a moist pre-form fiber truss under compressive pressures preferably greater than 100 psi, as mentioned earlier. The shape of the pre-form fiber truss is now approximately the shape of the finished fiber truss, except that the wall thickness of the pre-form fiber truss is much greater than the wall thickness of the finished fiber truss, because of swelling caused by the moisture retained in the pre-form fiber truss.

After the pre-form fiber truss has been compacted at the wet-forming station 69, the punch 55 is withdrawn from the deckle 38. As the punch 55 is withdrawn, the pre-form fiber truss is held to the forming surface of the moveable wet-forming die 52 through vacuum forces between the truss and the moveable wet-forming die 52. Vacuum forces in this location result from the closure of valves at the upper fluid-discharge ports 62, which prevents air infiltration between the pre-form fiber truss and the die 52. As the punch 55 and pre-form are withdrawn within the deckle 38, a vacuum space is created below the pre-form. Vacuum suction produced in this space during withdrawal of the punch 55 then draws fresh slurry into the deckle 38 through the slurry inlet openings 82.

As mentioned previously, a small volume of air can be introduced just below the compacted pre-form fiber truss during the initial portion of the upward stroke of the punch 55 in order to increase the separation between the pre-form fiber truss held to the moveable wet-forming die 52 and the advancing slurry. The space separating the pre-form fiber truss from the slurry is vented to atmosphere just before the punch 55 and the pre-form fiber truss are fully withdrawn above the top of the deckle 38. The venting operation halts the intake of slurry and facilitates removal of the punch 55 and pre-form fiber truss from the deckle 38. To complete the wet-forming operation, the pre-form fiber truss is held in a transfer position above the deckle 38, where it waits to be moved to the truss finishing station 90 on the transfer caul 96.

Synchronized with the downward stroke of the wet-forming press at the wet-forming station 69, the pre-form fiber truss prepared prior to initialization of the forming cycle as described in initial condition (d), is transferred to the upper hot-press die 92 using a short down-up movement of the upper platen 93 of the hot press. Simultaneously, the finished fiber truss prepared prior to initialization of the forming cycle, as described in initial condition (e), is transferred from the lower hot-press die 94 to the undersurface of the caul 96 using a short up-down stroke of the lower finishing assembly 97.

There is no need to move the bulky lower platen 91 of the hot press to accomplish this transfer. Instead, the much lighter lower finishing assembly 97 can carry the previously finished fiber truss to the transfer caul 96. In this case, the lower finishing assembly 97 can be moved to and from the caul 96 using a relatively simple screw-jack mechanism 100. Vacuum suction may be applied to pores or passages in the caul 96 to draw and hold the previously finished fiber truss on the lower surface of the caul 96. Pressurized air may be blown through the venting passages in the lower hot-press die 94 to assist in the release of the previously finished fiber truss from the lower finishing assembly 97.

Once the above transfers have been made, the caul 96 carries the previously finished fiber truss, held to the caul 96 by vacuum forces, to a post-processing station (not shown) to the right of the truss finishing station 90 in FIG. 6. At the post-processing station, the previously finished fiber truss is ejected from the transfer caul 96, and undergoes further processing, such as bonding to skins, or bonding to other fiber trusses. If no further processing is required the finished fiber trusses may be stacked at the post-processing station for storage and subsequent use.

If the post-processing operation involves bonding skins to finished fiber trusses like those depicted in FIG. 1, to form composite sandwich panels, adhesive may be applied to the lower side of the fiber trusses using a roll applicator 104 that spreads the adhesive across the truss ridges 6 as the finished fiber truss is conveyed on the underside of the caul 96 to the post-processing station. The truss may then be ejected from the caul 96 and laid on a lower skin as a first step in producing a sandwich panel. Adhesive may be subsequently applied to ridges 6 on the top side of the truss and a second skin attached to the top of the truss, producing a completed sandwich panel. Alternatively, other fiber trusses may be bonded to the top side of the finished truss at the post-processing station in the various ways disclosed in U.S. Pat. No. 5,900,304 to form thicker, stiffer, and stronger sandwich-panels. To save material, one of the exterior skins can be eliminated in stacked configurations. In this situation, reinforcement and rigidity are provided largely through the truss interconnections.

Immediately after the caul 96 has moved to the post-processing station and away from the space between the hot-press dies 92 and 94, the hot-press is energized and the hot-press dies 92 and 94 are brought together to consolidate and dry the previously prepared pre-form fiber truss that was transferred from the caul 96 to the upper hot-press die 92, in the initial portion of the hot-press cycle. To produce rapid drying of the fiber truss, the preferred temperature range of the hot-press dies 92 and 94 is approximately 300–500 degrees F. The higher the temperature, the more rapid will be the drying rate. The upper temperature of this preferred range is the upper operating temperature of many commercial hot presses. In addition, with an upper temperature of approximately 500 degrees F., overheating of the surface of the fiber truss may be avoided.

The pressure applied to the fiber truss in the drying step is preferably greater than about 100 psi in order to form fiber trusses having desirable strength. As the finishing pressure is increased, fiber density is increased and inter-fiber bonds are improved, leading to greater truss strength. Using rigid metal dies, it is possible to devise a drying system capable of applying pressures in excess of 2500 psi. In experimental tests of the invention, a pressure of 1500 psi, the maximum pressure available in the tests, was routinely applied using aluminum dies in the drying operation. Pressures below approximately 100 psi may also be applied in the drying operation to produce softer, more yielding fiber trusses that would be suitable for many cushioning applications. As mentioned earlier, if pressure can be applied to the pre-form at a sufficiently rapid rate and if die temperature can be maintained in the aforementioned range, it should be possible to dry the pre-form by means of impulse drying mechanisms. Compared to conventional press-drying, impulse drying should produce substantially faster drying and much greater energy efficiency, for reasons previously stated.

After the fiber truss has been dried, the hot press opens and the finished fiber truss is held against the lower hot-press die 94. The now empty transfer caul 96 shuttles from the post-processing station to the wet-forming station 69. At the wet-forming station 69, the newly produced pre-form fiber truss is then transferred to the upper surface of the caul 96 in a short down-up stroke of the upper platen 70 of the wet-forming press 130. The moist pre-form fiber truss is then shuttled to the finishing station 90, to complete one full production cycle.

TABLE I contains a summary of the various actions just described. TABLE II contains a schedule of the actions keyed to the numbered steps shown in TABLE I. It is assumed in the schedule presented in TABLE II that the hot-press remains closed for 10 seconds in order to adequately consolidate and dry the fiber truss, and the slurry is discharged from the deckle 38 in 3 seconds. These assumptions are based upon test results established during experimental production of fiber trusses. Taking into account the additional time required for truss transfers, the apparatus depicted in FIG. 7 will produce one fiber truss every 20 seconds.

However, the wet-forming station in the scenario depicted in the figures is utilized during only half of the production cycle. If desired, a second truss finishing station could be added to the left of the wet-forming station 69 to utilize the excess capacity of the wet-forming station 69. TABLE II then presents a schedule of actions for fiber truss production in this situation. It is clear from TABLE II that a single wet-forming station and two truss finishing stations can be synchronized to produce a finished fiber truss every 10 seconds, or 6 fiber trusses per minute. This production rate is high enough to make the apparatus attractive for mass-production of fiber trusses. If each press could be made large enough to accommodate two fiber trusses simultaneously, production rates would be correspondingly doubled, making the apparatus even more attractive for mass production of fiber trusses.

Although the examples above have focussed upon formation of fiber trusses like those disclosed in U.S. Pat. No. 5,900,304, it is to be understood that the method and apparatus disclosed herein can be applied to a wide range of three-dimensional fibrous structures that may be formed or molded from a fiber slurry. For example, the pyramidal core structure disclosed by Patterson in U.S. Pat. No. 4,495,237 can be produced from a pair of substantially identical fiber trusses made according to the method and apparatus disclosed herein. Each of the individual fiber trusses which define the composite pyramidal core structure of Patterson will be referred to herein as a "pyramidal truss structure" or a "pyramidal truss". The detailed shape of the pyramidal truss structure is displayed in FIG. 1 of U.S. Pat. No. 4,495,237. While Patterson discloses the pyramidal core structure and describes its advantages, there is no suggestion made regarding methods or apparatus for the production of the individual pyramidal truss structures that comprise the pyramidal core structure.

Figure 8:
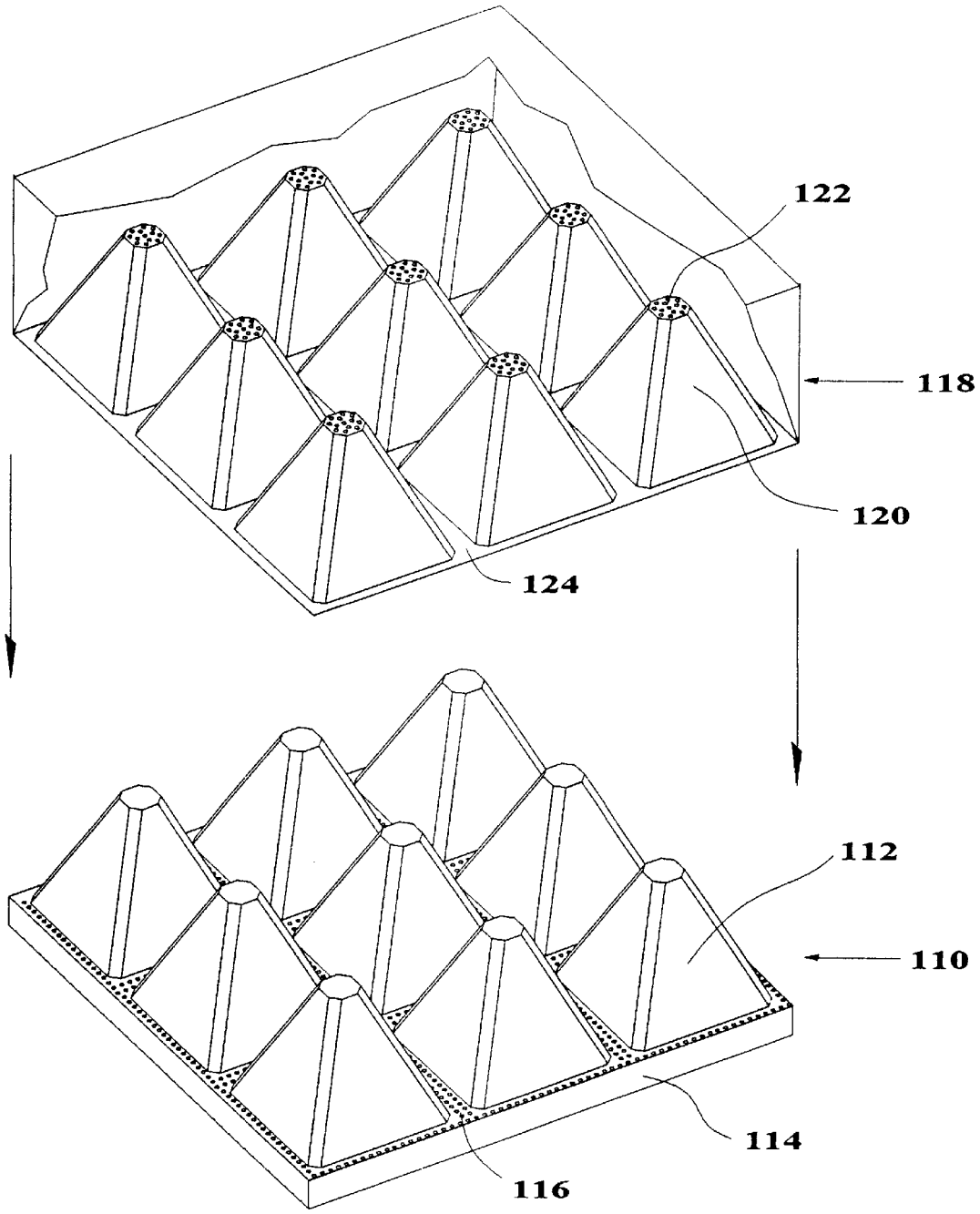
FIG. 8 shows a perspective drawing of a pair of foraminous dies that could be incorporated into the disclosed method and apparatus in order to form the pyramidal fiber truss disclosed by Patterson in U.S. Pat. No. 4,495,237.

To produce the pyramidal truss structure according to the method and apparatus disclosed herein, a pair of foraminous wet-forming pyramidal dies 110 and 118 having forming surfaces like those depicted in FIG. 8 would replace the corresponding wet-forming dies 20 and 52 in the apparatus shown in FIGS. 3–5. The fixed pyramidal die 110 in FIG. 8 includes a series of truncated pyramidal die protrusions 112 extending from a flat base 114. The region of the flat base 114 between truncated pyramidal die protrusions 112 contains a series of carrier fluid-discharge passages 116 similar to the fluid-discharge passages 16 in the wet-forming die 8 of FIG. 2. Additional fluid-discharge passages could also be distributed over the sloping surfaces of the pyramidal die protrusions 112 and pyramidal die recesses 120 to more evenly distribute fiber when there are very deep recesses or very steep angled surfaces in the die 110.

The moveable pyramidal die 118 includes a series of truncated pyramidal die recesses 120 set back from a flat base 124. A cluster of carrier fluid-discharge passages 122 are formed in the truncated interior surfaces of each of the pyramidal die recesses 120. The pyramidal die protrusions 112 of the fixed pyramidal die 110 nest into the truncated pyramidal die recesses 120 of the moveable pyramidal die 118 in producing the hollow pyramidal protrusions of the finished pyramidal truss structure. It should be understood that the scope of the invention for this example includes formation of pyramidal truss structures when the moveable pyramidal die 118 and the fixed pyramidal die 110 are interchanged so that the moveable pyramidal die 118 becomes the fixed pyramidal die attached to and surrounded by a deckle, and the fixed pyramidal die 110 becomes the moveable wet-forming die.

The ancillary equipment and procedures for forming the pyramidal truss structure are the same as the equipment and procedures for forming the truss shown in FIG. 1, with the simple replacement of the dies 20 and 52 with the new dies 110 and 118. The actions and cyclic schedules for making the pyramidal truss structure using the substituted dies 110 and 118, are identical to those presented in TABLE I and TABLE II.

In an analogous manner, substitute foraminous dies may also be fashioned to produce the fiber trusses making up the polyhedral-shaped cores of Figge disclosed in U.S. Pat. No. 4,348,442. In these cases, each truss is composed of hollow truncated polyhedral protrusions from a truss base. Each of the individual fiber trusses disclosed by Figge will be referred to in general as a "polyhedral truss structure" or a "polyhedral truss". Pairs of polyhedral truss structures are interconnected and bonded together in the invention of Figge to form a composite structural panel that exhibits a nearly isotropic reaction to external loads.

By analogy with the formation of the pyramidal truss structure, the fixed wet-forming die and the moveable wet-forming die required to form the polyhedral truss structure of Figge would have truncated polyhedral die protrusions and truncated polyhedral die recesses corresponding to the pyramidal die protrusions 112 and pyramidal die recesses 120, respectively, of the pyramidal dies 110 and 118 shown in FIG. 8. The truncated polyhedral die protrusions required in the dies for forming the polyhedral trusses of Figge extend from a flat truss base analogous to the flat truss base 114 of the fixed pyramidal die 110. The truncated polyhedral die recesses of the dies for forming the polyhedral trusses of Figge are set back from a flat truss base analogous to the flat truss base 124 of the moveable polyhedral die 118 shown in FIG. 8.

SUMMARY OF NOVEL AND UNOBVIOUS FEATURES OF THE INVENTION

The invention described herein is to be distinguished from the prior art in that the disclosed method and apparatus offer rugged yet relatively simple means for greatly increasing the formation speed and improving the physical properties of a three-dimensional fiber truss produced from a fiber slurry. The most commonly used and most closely related prior methods and apparatus for forming a fiber truss from a fiber slurry entail depositing a single layer of fiber onto a single foraminous die immersed in a fiber slurry. Force to deposit fiber from the slurry is applied through a gaseous pressure differential across the forming die. Fiber truss formation by these widely used techniques is lumpy and wall thickness is erratic. A smooth surface is formed only on one side of the truss. In addition, the deposited fiber retains a large amount of water, resulting in high energy costs for drying the truss.

In contrast to widely used techniques, the present invention inculcates the simultaneous deposition of fiber mixed in a slurry and contained within a deckle onto an upper forming surface as well as a lower forming surface of a pair of foraminous dies. Fiber is deposited on the forming surfaces of the pair of dies by applying pressure differentials across both dies. In further contrast to widely used methods, these pressure differentials are produced by mechanical compression of the slurry between the pair of foraminous dies. This procedure produces a fiber truss having improved fiber distribution, uniform fiber truss thickness, and smooth surfaces on both dies of the truss. Much thicker fiber trusses may also be produced compared to fiber trusses produced using common methods. Using rigid high-strength wet-forming dies, large compressive forces may be applied to compact the fiber in the wet-forming stage. High levels of compaction result in a pre-form fiber truss having low moisture content, leading to lower energy costs for drying the fiber truss.

The prior art of Shetka, contained in U.S. Pat. Nos. 4,994,148 and 5,064,504, discloses a method for wet-forming an object from a pulp by squeezing the pulp between a pair of foraminous plates. The present invention differs from the invention of Shetka in several important ways. First of all, unlike the invention of Shetka, the present invention does not utilize an enclosure that is foraminous on all of the surfaces of the enclosure. With fluid-discharge passages on all surfaces, fiber is deposited on all surfaces. Adapting Shetka's suggestion to the present invention, fluid-discharge passages would be placed in the walls of the deckle in contrast to the smooth, impervious deckle walls disclosed herein. With fluid-discharge passages in the deckle walls, fluid discharge through the deckle would leave deposited fiber along the deckle walls. Fiber deposited along the deckle walls would be swept ahead of the leading edge of the moving die in the wet-forming operation. Excessive fiber would then accumulate around the perimeter of the fiber truss, as the wet-forming dies compacted the fiber, leading to a poorly formed truss having a non-uniform fiber density throughout the truss.

In the present invention, only the forming dies are foraminous and there is no fluid discharge through the impervious deckle walls. In this way, fiber is deposited only over the forming surfaces of the dies as the dies are pressed against the fiber slurry and the carrier fluid is discharged. Since the surface area of the two sides of a thin fiber truss are far greater than the area of the thin edges of the truss, placement of additional fluid-discharge passages in the deckle walls to discharge slurry from the edge of the truss would not increase fluid-discharge speed of thin fiber trusses by any significant amount.

In fact, with the inclusion of foraminous walls on all surfaces of the pulp enclosure of Shetka, it is apparent that the invention of Shetka is intended for the formation of a relatively thick part, where carrier-fluid discharge from the edges of the part would be advantageous. Shetka does not suggest the use of his method and apparatus for forming the relatively thin and structurally complex geometric forms that are the focus of the present invention. In fact, in order to produce even relatively simple shallow embossments on the surface of parts formed according to the invention of Shetka, a separate impervious embossing plate is laid over the foraminous wall opposite the moveable foraminous plate. Discharge of carrier fluid in this situation would be greatly impeded by the impervious embossing plate.

In addition, the foraminous walls which surround the perimeter of the moveable wall in the invention of Shetka, are not conducive to the use of a sliding seal in the perimeter of the moveable wall, since a sliding seal requires a smooth impervious surface, not present along the fixed side walls in the invention of Shetka. In fact, Shetka does not suggest the use of a sliding seal. Without a seal between the moveable wall and the fixed wall surrounding the moveable wall, slurry will leak around the moveable wall in the invention of Shetka. By way of this leakage path, fiber will be undesirably deposited in the space between the moveable wall and the adjacent walls of the slurry enclosure. In addition, as the moveable wall compresses the slurry, fluid-discharge pressure and associated fluid-discharge speeds are limited by leakage around the moveable wall.

Because the deckle walls of the present invention are smooth and impervious, unlike the invention of Shetka, a sliding seal can be fixed around the periphery of the wet-forming punch, which is composed of the moveable wet-forming die and the plunger. The inclusion of a sliding seal between the wet-forming punch and the deckle prevents the flow of slurry around the moveable wet-forming die. This assures that fiber is not deposited in the space between the wet-forming punch and the deckle. By preventing slurry leakage in this space, the seal also permits wet-forming at much higher pressures than are possible without a sliding seal. Formation at higher-pressure leads directly to shorter forming times. In addition, the ability to produce extremely high slurry pressures and high flow velocities in the slurry can be used to drive fiber into very deep recesses or other intricate features of some truss geometries when fluid-discharge passages are provided to allow flow in these areas.

In addition, a sliding seal between the periphery of the wet-forming punch and the deckle can be utilized to create a vacuum within the slurry enclosure as the moveable wet-forming die is withdrawn from the deckle. Vacuum suction can then be used to draw slurry into the slurry enclosure through slurry inlet openings in the deckle or through slurry inlet openings in the bottom cover of the deckle. The forming cycle time is minimized by this means since slurry filling for a subsequent production cycle can be performed simultaneously with withdrawal of a pre-form fiber truss from the deckle. This scheme also makes efficient use of machine hardware by using the same components for both forming and filling, thereby eliminating the need for a separate stand-alone slurry filling system.

Additional novelty exists in the discovery that a fiber truss can be formed using dies that are foraminous only over the base surfaces between protrusions or over the bottom surfaces of recesses in the forming dies. Fluid-discharge passages are easily fabricated in these regions. In experimental tests of this discovery, highly uniform fiber distribution was obtained over the forming surfaces of experimental dies in which protrusion angles were 45 degrees and protrusion heights were approximately 1 cm.

While the invention has been described in detail above, it is to be understood that this is by way of example only and the protection granted is to be limited solely by the spirit of the invention and the scope of the following claims.

TABLE I

Events occurring in the production of a structural web.

| | ACTION | DESCRIPTION | TIME INTERVAL (seconds) |
|---|---|---|---|
| WET PRESS STEP NUMBER | | | |
| Initial Condition | | - Press is fully opened, deckle is filled with slurry - | |
| 1 | Press Down Stroke | Slurry is drained, a damp preform is produced. | 3 |
| 2 | Press Up Stroke | New slurry drawn into deckle, pre-form is lifted to transr position. | 3 |
| 3 | Caul Insertion | Moveable caul is positioned in wet press beneath pre-form. | 1.5 |
| 4 | Pre-form Transfer | Pre-form is transferred from upper mold of press to moveable caul. | 1 |
| 5 | Pre-form Removal | Pre-form is transferred to hot press station using moveable caul. | 1.5 |
| HOT PRESS STEP NUMBER | | | |
| Initial Condition | | - Press is fully opened, caul is positioned between mold plates - | |
| 1 | Pre-form Transfer | Wet pre-form is transferred from caul to upper mold of the hot-press. | 1 |
| 2 | Core Transfer | A finished core is transferred from lower mold to lower caul surface. | 1 |
| 3 | Core Removal | Caul moves finished core to post-processing station. | 2 |
| 4 | Press Down Stroke | Hot mold plates contact and compresses the damp pre-form. | 1 |
| 5 | Hot Press Dwell | Pre-form is consolidated and dried into a finished core. | 10 |
| 6 | Press Up Stroke | Press opens, finished core stays with lower mold plate. | 1 |
| 7 | Press Standby | Empty caul is moved from post-process station to wet press station. | 1.5 |
| 8 | Pre-form Insertion | Caul is moved from wet press to hot press cariying the pre-form. | 1.5 |

TABLE I-continued

Events occurring in the production of a structural web.

| POST PROCESS STEP NUMBER | ACTION | DESCRIPTION | TIME INTERVAL (seconds) |
|---|---|---|---|
| Initial Condition | | - Station is idle, caul has received finished core from hot press - | |
| 1 | Core Transfer | Caul carries finished core from hot press to post-processing station. | 2 |
| 2 | Core Post Process | Finished core is ejected and stacked or bonded to panels, etc. | 16.5 |
| 3 | Caul Transfer | Empty caul moves from post-processing station to wet press. | 1.5 |

TABLE II

Sequence of events for structural web production.

| TIME (SEC.) | WET PRESS | HOT PRESS #1 | POST PROCESS #1 | HOT PRESS #2 | POST PROCESS #2 |
|---|---|---|---|---|---|
| 0 | 1 | 1 & 2 | | | |
| 1 | | 3 | 1 | | |
| 2 | | | | | |
| 3 | 2 | 4 | 2 | | |
| 4 | | 5 | 3 | 6 | |
| 5 | | | | 7 | |
| 6 | 3 | | | | 4 |
| 7 | | | | | |
| | 4 | | | 8 | |
| 8 | | | | | |
| | 5 | | | | |
| 9 | | | | | |
| 10 | 1 | | | 1 & 2 | |
| 11 | | | | 3 | 1 |
| 12 | | | | | |
| 13 | 2 | | | 4 | 2 |
| 14 | | 6 | | 5 | 3 |
| 15 | | 7 | | | |
| 16 | 3 | | 4 | | |
| 17 | | | | | |
| | 4 | 8 | | | |
| 18 | | | | | |
| | 5 | | | | |
| 19 | | | | | |
| 20 | 1 | 1 & 2 | | | |

I claim:

1. A method for forming from a fiber slurry a three-dimensional fiber truss, said three-dimensional fiber truss comprising:

(i) a three-dimensional first truss-exterior surface including three-dimensional surface variations;

(ii) a three-dimensional second truss-exterior surface opposite said first truss-exterior surface, wherein said second truss-exterior surface is spaced from said first truss-exterior surface by a distance less than approximately the average amplitude of said three-dimensional surface variations in said first truss-exterior surface, and;

(iii) a solidified fiber mass filling a space between said first truss-exterior surface and said second truss-exterior surface, and said method comprising the steps of:

(a) providing a wet-forming station comprising:

(1) a substantially-rigid moveable wet-forming die comprising a three-dimensional first forming surface that substantially matches said first truss-exterior surface, a first back surface opposite said first forming surface including a substantially-rigid material there between, a first die peripheral surface connecting the perimeter of said first forming surface with the perimeter of said first back surface, and a plurality of first fluid-discharge passages comprising foramina extending into said rigid material of said moveable wet-forming die from said first forming surface;

(2) a substantially-rigid fixed wet-forming die comprising a three-dimensional second forming surface that substantially matches said second truss-exterior surface, a second back surface opposite said second forming surface including a substantially-rigid material there between, a second die peripheral surface connecting the perimeter of said second forming surface with the perimeter of said second back surface, and a plurality of second fluid-discharge passages comprising foramina extending into said rigid material of said fixed wet-forming die from said second forming surface;

(3) a deckle comprising a substantially-rigid impermeable frame surrounding a deckle interior space, said deckle interior space comprising a prismatic volume including a cross-sectional outline that encompasses said first die peripheral surface so that said moveable wet-forming die can traverse an axial length of said prismatic volume of said deckle interior space;

(4) a bottom cover for said deckle, said bottom cover being attached to an open end of said deckle and said bottom cover comprising said fixed wet-forming die, wherein said second forming surface of said fixed wet-forming die is exposed to and faces towards said deckle interior space so that said fiber slurry occupies a slurry space that is within said deckle interior space and above a predetermined area of said second forming surface;

(5) a filling means for adding said fiber slurry to said slurry space;

(6) a pressing means for urging said moveable wet-forming die along said axial length of said prismatic volume, said pressing means including a wet-forming punch, said wet-forming punch comprising said moveable wet-forming die and a plunger connected to said moveable wet-forming die;

(b) adding a predetermined quantity of said fiber slurry to said slurry space using said filling means;

(c) compressing at a pre-selected rate said fiber slurry, contained in said slurry space, between said first forming surface and said second forming surface using said pressing means so that a carrier fluid in said fiber slurry is discharged from said fiber slurry through said first fluid-discharge passages and said second fluid-discharge passages and fibers from said fiber slurry are concentrated and compacted into a pre-form fiber truss between said first forming surface and said second forming surface;

(d) providing a truss finishing station including means for removing a pre-selected quantity of said carrier fluid from within said pre-form fiber truss;

(e) removing said pre-form fiber truss from said deckle interior space and moving said pre-form fiber truss to said truss finishing station;

(f) removing said pre-selected quantity of said carrier fluid from within said pre-form fiber truss at said truss finishing station, whereby said fiber mass is dried and solidified, and said three-dimensional fiber truss is produced, and;

(g) removing said three-dimensional fiber truss from said truss finishing station.

2. The method of claim 1, wherein said first truss-exterior surface and said second truss-exterior surface include corrugations, said corrugations including ridges, valleys, syncline indentations, and anticline protrusions, said syncline indentations being disposed along said ridges and indenting into said ridges of said corrugations, said syncline indentations on said first truss-exterior surface of said fiber truss forming anticline protrusions on said second truss-exterior surface of said fiber truss and said syncline indentations on said second truss-exterior surface of said fiber truss forming anticline protrusions on said first truss-exterior surface of said fiber truss, said anticline protrusions bridging across valleys of said corrugations, whereby said corrugations are reinforced and said fiber truss is stiffened in directions generally normal to said ridges of said corrugations.

3. The method of claim 2, wherein:

(a) said first forming surface comprises a plurality of first surface features including first die valleys of first die corrugations and first die bottoms of first die syncline indentations, wherein said first die valleys substantially match said ridges of said corrugations on said first truss-exterior surface, and said first die bottoms substantially match tops of said anticline protrusions on said first truss-exterior surface;

(b) said second forming surface includes a plurality of second surface features including second die valleys of second die corrugations and second die bottoms of second die syncline indentations, wherein said second die valleys substantially match said ridges of said corrugations on said second truss-exterior surface and said second die bottoms substantially match tops of said anticline protrusions on said second truss-exterior surface, and wherein said first fluid-discharge passages comprise foramina in said first die valleys and said first die bottoms.

4. The method of claim 1, wherein said fiber truss comprises a pyramidal truss structure, said pyramidal truss structure comprising a plurality of spaced hollow pyramidal truss protrusions in both the longitudinal and latitudinal directions which extend from a truss base, wherein each of said plurality of spaced hollow pyramidal truss protrusions include a square base, beveled edges at all four corners, a top comprising a truncated apex, and a face structure connecting said square base with said truncated apex, and wherein said truss base comprises a connective member connecting together the square bases of said plurality of spaced hollow pyramidal truss protrusions.

5. The method of claim 4, wherein:

(a) said pyramidal truss protrusions extend from one side of said truss base;

(b) said first forming surface comprises a plurality of pyramidal die recesses, wherein each of said pyramidal die recesses includes a truncated recessive apex;

(c) said second forming surface comprises die channels and a plurality of pyramidal die protrusions extending from a die base, wherein each of said pyramidal die protrusions includes a truncated projectile apex and said die channels comprise a surface of said die base connecting together said pyramidal die protrusions;

(d) said plurality of first fluid-discharge passages of said moveable wet-forming die include openings in said truncated recessive apices of said pyramidal die recesses;

(e) said plurality of second fluid-discharge passages of said fixed wet-forming die include openings in said die channels.

6. The method of claim 4, wherein:

(a) said pyramidal truss protrusions extend from one side of said truss base;

(b) said first forming surface comprises die channels and a plurality of pyramidal die protrusions extending from a die base, wherein each of said pyramidal die protrusions includes a truncated projectile apex and said die channels comprise a surface of said die base connecting together said pyramidal die protrusions;

(c) said second forming surface comprises a plurality of pyramidal die recesses, wherein each of said pyramidal die recesses includes a truncated recessive apex;

(d) said plurality of first fluid-discharge passages of said moveable wet-forming die includes openings in said die channels;

(e) said plurality of second fluid-discharge passages of said fixed wet-forming die includes openings in said truncated recessive apices of said pyramidal die recesses.

7. The method of claim 1, wherein said fiber truss comprises a polyhedral truss structure, said polyhedral truss structure comprising a plurality of spaced hollow polyhedral protrusions extending from a truss base, wherein each of said plurality of spaced hollow polyhedral protrusions comprise a polygonal base, a truncated apex, and a face structure connecting said polygonal base with said truncated apex, and wherein said truss base comprises a connective member connecting together the polygonal bases of said plurality of spaced hollow polyhedral protrusions.

8. The method of claim 7, wherein:

(a) said polyhedral truss protrusions extend from one side of said truss base;

(b) said first forming surface comprises a plurality of polyhedral die recesses, wherein each of said polyhedral die recesses includes a truncated recessive apex;

(c) said second forming surface comprises die channels and a plurality of polyhedral die protrusions extending from a die base, wherein each of said polyhedral die protrusions includes a truncated projectile apex and said die channels comprise a surface of said die base connecting together said polyhedral die protrusions;

(d) said plurality of first fluid-discharge passages of said moveable wet-forming die include openings in said truncated recessive apices of said polyhedral die recesses;

(e) said plurality of second fluid-discharge passages of said fixed wet-forming die include openings in said die channels.

9. The method of claim 7, wherein:

(a) said polyhedral truss protrusions extend from one side of said truss base;

(b) said first forming surface comprises die channels and a plurality of polyhedral die protrusions extending from a die base, wherein each of said polyhedral die protrusions includes a truncated projectile apex and said die channels comprise a surface of said die base connecting together said polyhedral die protrusions;

(c) said second forming surface comprises a plurality of polyhedral die recesses, wherein each of said polyhedral die recesses includes a truncated recessive apex;

(d) said plurality of first fluid-discharge passages of said moveable wet-forming die includes openings in said die channels;

(e) said plurality of second fluid-discharge passages of said fixed wet-forming die includes openings in said truncated recessive apices of said polyhedral die recesses.

10. The method of claim 1, including the further step of providing a sliding seal between said wet-forming punch and said impermeable frame of said deckle, whereby wet-forming pressure that would otherwise be produced in the absence of said sliding seal is increased by providing said sliding seal, and said fibers and said carrier fluid are blocked from passage through a space between said first die peripheral surface and said impermeable frame of said deckle.

11. The method of claim 1, wherein said filling means includes:

(a) a fiber slurry inlet comprising a plurality of slurry inlet passages into said slurry space, wherein said inlet passages enter said slurry space at predetermined positions so that said fiber in said fiber slurry is distributed substantially uniformly throughout said slurry space, and openings of said slurry inlet passages into said slurry space do not intersect with a path of said sliding seal, whereby a seal between said wet-forming punch and said impermeable frame of said deckle is sustained and damage to said sliding seal avoided as said moveable wet-forming die is urged along said axial length of said prismatic volume of said deckle, and;

(b) means for preventing fluid discharge of said fiber slurry through said slurry inlet passages, whereby during said step of compressing at a pre-selected rate said fiber slurry, carrier fluid from said slurry space is substantially constrained to flow through said plurality of first fluid-discharge passages and said plurality of said second fluid-discharge passages, and substantially all of said fiber is deposited against said first forming surface and said second forming surface, and, wherein said step of adding a predetermined quantity of said fiber slurry to said slurry space using said filling means includes adding said fiber slurry to said slurry space through said fiber slurry inlet, and said step of compressing at a pre-selected rate said fiber slurry includes preventing fluid discharge through said slurry inlet passages during said compressing.

12. The method of claim 11, wherein said filling means includes means for blocking flow of said carrier fluid in said first fluid-discharge passages and said second fluid-discharge passages, and said step of adding a predetermined quantity of said fiber slurry to said slurry space using said filling means includes stopping flow of said carrier fluid in said first fluid-discharge passages and said second fluid-discharge passages using said means for blocking flow and withdrawing said moveable wet-forming die along said prismatic volume of said deckle interior space and away from said fixed wet-forming die, whereby a vacuum suction is produced in said slurry space to draw said fiber slurry into said slurry space through said plurality of slurry inlet passages.

13. The method of claim 1, wherein said step of removing said pre-selected quantity of said carrier fluid from within said pre-form fiber truss comprises removing said pre-selected quantity of said carrier fluid using impulse drying.

14. The method of claim 1, wherein said means for removing a pre-selected quantity of said carrier fluid from within said pre-form fiber truss includes:

(a) a substantially-rigid first hot-press die comprising a first heated forming surface substantially matching said first truss-exterior surface and a plurality of first vent passages extending into said first hot-press die from said first heated forming surface, whereby said carrier fluid and vapor from said carrier fluid in said pre-form fiber truss escapes through said first hot-press die;

(b) a substantially-rigid second hot-press die comprising a second heated forming surface substantially matching said second truss-exterior surface and a plurality of second vent passages extending into said second hot press die from said second heated forming surface, whereby said carrier fluid and said vapor from said carrier fluid in said pre-form fiber truss escapes through said second hot-press die, and; including the further step of compressing said pre-form fiber truss between said first heated forming surface and said second heated forming surface, whereby said pre-form fiber truss is dried under simultaneous application of heat and pressurized restraint so that the strength of said three-dimensional fiber truss is increased compared to said strength when said pre-form fiber truss is dried without pressurized restraint, and wherein said step of removing said pre-selected quantity of said carrier fluid from within said pre-form fiber truss comprises contacting said pre-form fiber truss with said first heated forming surface and said second heated forming surface during said step of compressing said pre-form fiber truss between said first heated forming surface and said second heated forming surface, whereby said carrier fluid is vaporized by heat transfer from said first heated forming surface and said second heated forming surface to said pre-form fiber truss.

15. The method of claim 14, wherein said first vent passages are disposed along bottoms of recesses in said first heated forming surface, and said second vent passages are disposed along bottoms of recesses in said second heated forming surface.

16. The method of claim 1, wherein said fibers are selected from the group consisting of wood fiber, straw fiber, grass fiber, cane fiber, reed fiber, bast fiber, seed hair, and non-plant synthetic fiber.

17. The method of claim 1, wherein said fiber truss includes an additive selected from the group consisting of a fiber-bonding agent, a sizing agent, a fire retardant, an impregnating resin, an insect repellant, a preservative, an anti-bacterial agent, a water repellant, and a wet-strength agent.

18. A method for forming from a fiber slurry a three-dimensional pre-form fiber truss, said pre-form fiber truss comprising:

(i) a three-dimensional first truss-exterior surface;

(ii) a three-dimensional second truss-exterior surface spaced from and opposite said first truss-exterior surface, and;

(iii) a fiber mass filling a space between said first truss-exterior surface and said second truss-exterior surface, and said method comprising the steps of:

(a) providing a wet-forming station comprising:

(1) a substantially-rigid moveable wet-forming die comprising a three-dimensional first forming surface that substantially matches said first truss-exterior surface, a first back surface opposite said first forming surface including a substantially-rigid material there between, a first die peripheral surface connecting the perimeter of said first forming surface with the perimeter of said first back surface, and a plurality of first fluid-discharge passages comprising foramina extending into said rigid material of said moveable wet-forming die from said first forming surface;

(2) a substantially-rigid fixed wet-forming die comprising a three-dimensional second forming surface that substantially matches said second truss-exterior surface, a second back surface opposite said second forming surface including a substantially-rigid material there between, a second die peripheral surface connecting the perimeter of said second forming surface with the perimeter of said second back surface, and a plurality of second fluid-discharge passages comprising foramina extending into said rigid material of said fixed wet-forming die from said second forming surface;

(3) a deckle comprising a substantially-rigid impermeable frame surrounding a deckle interior space, said deckle interior space comprising a prismatic volume including a cross-sectional outline that encompasses first die peripheral surface so that said moveable wet-forming die can traverse an axial length of said prismatic volume of said deckle;

(4) a bottom cover for said deckle, said bottom cover being attached to an open end of said deckle and said bottom cover comprising said fixed wet-forming die, wherein said second forming surface of said fixed wet-forming die is exposed to and faces towards said deckle interior space so that said fiber slurry occupies a slurry space that is within said deckle interior space and above a predetermined area of said second forming surface;

(5) a filling means for adding said fiber slurry to said slurry space;

(6) a pressing means for urging said moveable wet-forming die along said axial length of said prismatic volume;

(b) adding a predetermined quantity of said fiber slurry to said slurry space using said filling means;

(c) compressing at a pre-selected rate said fiber slurry, contained in said slurry space, between said first forming surface and said second forming surface using said pressing means so that a carrier fluid in said fiber slurry is ejected from said fiber slurry through said first fluid-discharge passages and said second fluid-discharge passages and fibers from said fiber slurry are concentrated and compacted into said pre-form fiber truss between said first forming surface and said second forming surface, and;

(d) removing said pre-form fiber truss from said wet-forming station.

* * * * *